US011700979B2

(12) United States Patent
Mitchell et al.

(10) Patent No.: US 11,700,979 B2
(45) **Date of Patent: *Jul. 18, 2023**

(54) SANITARY TISSUE PRODUCT ROLLS

(71) Applicant: The Procter & Gamble Company, Cincinnati, OH (US)

(72) Inventors: Kevin Mitchell, West Chester, OH (US); Robert Edward Reinerman, Cincinnati, OH (US); Douglas Jay Barkey, Salem Township, OH (US); Mark Alan Green, Cincinnati, OH (US); Paul Dennis Trokhan, Hamilton, OH (US); J. Michael Bills, Mason, OH (US); Jeffrey Glen Sheehan, Symmes Township, OH (US); Paul Thomas Weisman, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 489 days.

This patent is subject to a terminal disclaimer.

(21) Appl. No.: 16/663,424

(22) Filed: Oct. 25, 2019

(65) Prior Publication Data

US 2020/0129013 A1 Apr. 30, 2020

Related U.S. Application Data

(60) Provisional application No. 62/750,888, filed on Oct. 26, 2018.

(51) Int. Cl.

| | |
|---|---|
| ***D21H 27/02*** | (2006.01) |
| ***A47K 10/22*** | (2006.01) |
| ***A47K 10/38*** | (2006.01) |
| ***D21H 27/00*** | (2006.01) |

(52) U.S. Cl.

CPC ..... *A47K 10/22* (2013.01); *A47K 10/38* (2013.01); *D21H 27/005* (2013.01); *D21H 27/02* (2013.01)

(58) Field of Classification Search

CPC .... D21H 27/002; D21H 27/005; D21H 27/30; D21H 27/02; A47K 10/16; A47K 10/38; A47K 10/22

USPC ..... 162/109

See application file for complete search history.

(56) References Cited

U.S. PATENT DOCUMENTS

| | | | |
|---|---|---|---|
| 3,815,519 | A | 6/1974 | Meyer |
| 3,877,576 | A | 4/1975 | Kishi et al. |
| 3,910,412 | A | 10/1975 | Vargo |
| 3,960,272 | A | 6/1976 | Hartbauer et al. |
| 3,977,619 | A | 8/1976 | Nagata |
| 3,994,771 | A | 11/1976 | Morgan, Jr. et al. |
| 4,135,024 | A | 1/1979 | Callahan et al. |
| 4,238,541 | A | 12/1980 | Burton |
| 4,300,981 | A | 11/1981 | Carstens |
| 5,335,869 | A | 8/1994 | Yamaguchi et al. |
| 5,344,027 | A | 9/1994 | Kaplan |
| 5,445,272 | A | 8/1995 | Crisp |
| 5,660,350 | A | 8/1997 | Byrne et al. |
| 5,667,162 | A | 9/1997 | McNeil et al. |
| 5,690,297 | A | 11/1997 | McNeil et al. |
| 5,712,210 | A | 1/1998 | Windisch |
| 5,732,901 | A | 3/1998 | McNeil et al. |
| 5,810,282 | A | 9/1998 | McNeil et al. |
| 5,839,585 | A | 11/1998 | Miller |
| 5,851,352 | A | 12/1998 | Vinson et al. |
| 5,899,404 | A | 5/1999 | McNeil et al. |
| 5,913,490 | A | 6/1999 | McNeil et al. |
| 6,021,890 | A | 2/2000 | Focke et al. |
| 6,077,590 | A | 6/2000 | Archer et al. |
| 6,142,407 | A | 11/2000 | McNeil et al. |
| 6,162,329 | A | 12/2000 | Vinson et al. |
| 6,304,855 | B1 | 10/2001 | Burke |
| 6,344,111 | B1 | 2/2002 | Wilhelm |
| 6,354,495 | B1 | 3/2002 | Powell |
| 6,354,530 | B1 | 3/2002 | Byrne et al. |
| 6,440,268 | B1 | 8/2002 | Baggot et al. |
| 6,454,095 | B1 | 9/2002 | Brisbois et al. |
| 6,568,530 | B2 | 5/2003 | Takahashi et al. |
| 6,579,416 | B1 | 6/2003 | Vinson et al. |
| 6,601,705 | B2 | 8/2003 | Molina et al. |
| 6,613,193 | B2 | 9/2003 | Wolkowicz et al. |
| 6,648,864 | B2 | 11/2003 | Ronn et al. |
| 6,746,569 | B1 | 6/2004 | Wolkowicz |
| 6,821,387 | B2 | 11/2004 | Hu |
| 6,845,282 | B2 | 1/2005 | Franz |
| 6,893,535 | B2 | 5/2005 | Hermans et al. |
| 6,966,971 | B1 | 11/2005 | Sellars et al. |
| 6,991,144 | B2 | 1/2006 | Franz et al. |

(Continued)

FOREIGN PATENT DOCUMENTS

| | | |
|---|---|---|
| CA | 3060193 A1 | 4/2020 |
| KR | 467346 Y1 | 6/2013 |

(Continued)

OTHER PUBLICATIONS

All Office Actions U.S. Appl. No. 16/663,441.
All Office Actions U.S. Appl. No. 16/663,460.
All Office Actions U.S. Appl. No. 16/663,470.
All Office Actions; U.S. Appl. No. 17/900,260, filed Aug. 31, 2022.
Unpublished U.S. Appl. No. 17/900,260, filed Aug. 31, 2022 to Kevin Mitchell et al.
U.S. Appl. No. 16/663,441, filed Oct. 25, 2019, Kevin Mitchell, et al.
U.S. Appl. No. 16/663,460, filed Oct. 25, 2019, Kevin Mitchell, et al.
U.S. Appl. No. 16/663,470, filed Oct. 25, 2019, Kevin Mitchell, et al.

*Primary Examiner* — Mark Halpern
(74) *Attorney, Agent, or Firm* — C. Brant Cook

(57) ABSTRACT

Sanitary tissue product rolls that exhibit novel combinations of physical properties, such as Moment of Inertia, Roll Density, and Roll Diameter, such that the sanitary tissue product rolls meet consumers' needs, and method for making such novel sanitary tissue product rolls and marketing such novel sanitary tissue product rolls are provided.

18 Claims, 15 Drawing Sheets

(56) References Cited

U.S. PATENT DOCUMENTS

| | | | | |
|---|---|---|---|---|
| 6,993,964 | B2 | 2/2006 | Franz et al. | |
| 7,000,864 | B2 | 2/2006 | McNeil et al. | |
| 7,029,121 | B2 | 4/2006 | Edwards | |
| 7,035,706 | B2 | 4/2006 | Franz | |
| 7,092,781 | B2 | 8/2006 | Franz et al. | |
| 7,172,073 | B2 | 2/2007 | Hanson | |
| 7,208,429 | B2 | 4/2007 | Vinson et al. | |
| 7,392,961 | B2 | 7/2008 | McNeil et al. | |
| 7,428,966 | B2 | 9/2008 | Goodall et al. | |
| 7,455,260 | B2 | 11/2008 | McNeil et al. | |
| 7,621,397 | B2 | 11/2009 | Boudrie et al. | |
| 7,687,140 | B2 | 3/2010 | Manifold et al. | |
| 7,704,601 | B2 | 4/2010 | Manifold et al. | |
| 7,803,249 | B2 | 9/2010 | Dyer et al. | |
| 7,931,632 | B2 | 4/2011 | Betts | |
| 8,662,301 | B2 | 3/2014 | Duval et al. | |
| 9,242,775 | B2 | 1/2016 | Knobloch et al. | |
| 9,327,888 | B2 | 5/2016 | Knobloch et al. | |
| 11,130,624 | B2 | 9/2021 | Knobloch et al. | |
| 11,447,916 | B2 * | 9/2022 | Mitchell | D21H 27/002 |
| 2003/0041496 | A1 | 3/2003 | Hagen et al. | |
| 2003/0066616 | A1 | 4/2003 | Wolkowicz et al. | |
| 2003/0127351 | A1 | 7/2003 | Takahashi et al. | |
| 2003/0201085 | A1 | 10/2003 | Vinson et al. | |
| 2003/0234199 | A1 | 12/2003 | Morita et al. | |
| 2004/0099389 | A1 | 5/2004 | Chen et al. | |
| 2004/0200752 | A1 | 10/2004 | Poli | |
| 2005/0033630 | A1 | 2/2005 | Kowalchuk | |
| 2005/0065492 | A1 | 3/2005 | Cole et al. | |
| 2005/0121347 | A1 | 6/2005 | Hanson | |
| 2005/0132904 | A1 | 6/2005 | Basler et al. | |
| 2005/0145353 | A1 | 7/2005 | Troxell | |
| 2005/0173281 | A1 | 8/2005 | Goodall et al. | |
| 2005/0279579 | A1 | 12/2005 | Milk et al. | |
| 2006/0168914 | A1 | 1/2006 | Steeves-Kiss et al. | |
| 2006/0069372 | A1 | 3/2006 | Chakravarty et al. | |
| 2006/0113049 | A1 | 6/2006 | Knobloch et al. | |
| 2006/0167425 | A1 | 7/2006 | Stellbrink et al. | |
| 2006/0195357 | A1 | 8/2006 | Klofta et al. | |
| 2006/0271427 | A1 | 11/2006 | Raimondo | |
| 2006/0288619 | A1 | 12/2006 | Henke et al. | |
| 2007/0043615 | A1 | 2/2007 | Dahleh et al. | |
| 2007/0055573 | A1 | 3/2007 | Grell | |
| 2007/0061188 | A1 | 3/2007 | Sakemiller et al. | |
| 2007/0095705 | A1 | 5/2007 | Legault et al. | |
| 2007/0095706 | A1 | 5/2007 | Legault et al. | |
| 2007/0100692 | A1 | 5/2007 | Minifie et al. | |
| 2007/0102559 | A1 | 5/2007 | McNeil et al. | |
| 2007/0156515 | A1 | 7/2007 | Hasselback et al. | |
| 2008/0051750 | A1 | 2/2008 | Schagen et al. | |
| 2008/0078685 | A1 | 4/2008 | Patterson et al. | |
| 2008/0097364 | A1 | 4/2008 | Yang | |
| 2008/0128308 | A1 | 6/2008 | Betts | |
| 2008/0202964 | A1 | 8/2008 | Knobloch et al. | |
| 2008/0202965 | A1 | 8/2008 | DuVal et al. | |
| 2008/0202968 | A1 | 8/2008 | Knobloch et al. | |
| 2008/0202549 | A1 | 10/2008 | Knobloch et al. | |
| 2008/0245491 | A1 | 10/2008 | Knobloch | |
| 2008/0245693 | A1 | 10/2008 | Vinson | |
| 2010/0028621 | A1 | 2/2010 | Byrne et al. | |
| 2010/0030174 | A1 | 2/2010 | Buschur et al. | |
| 2010/0122929 | A1 | 5/2010 | Mciver et al. | |
| 2010/0270412 | A1 | 10/2010 | Tondkar et al. | |
| 2011/0311345 | A1 | 12/2011 | McNeil | |
| 2012/0234712 | A1 | 9/2012 | Moore et al. | |
| 2012/0301536 | A1 | 11/2012 | Charest | |
| 2013/0327487 | A1 | 12/2013 | Espinosa et al. | |
| 2016/0137398 | A1 | 5/2016 | Lemke et al. | |
| 2016/0229606 | A1 | 8/2016 | Steeves-kiss et al. | |
| 2017/0007079 | A1 | 1/2017 | O'Brien Stickney et al. | |
| 2017/0183824 | A1 | 6/2017 | McNeil | |
| 2020/0002071 | A1 | 1/2020 | Anklam et al. | |
| 2020/0129014 | A1 * | 4/2020 | Mitchell | A47K 10/22 |
| 2020/0131707 | A1 * | 4/2020 | Mitchell | A47K 10/16 |
| 2020/0131709 | A1 * | 4/2020 | Mitchell | A47K 10/16 |
| 2021/0207328 | A1 | 7/2021 | Kato | |
| 2021/0230807 | A1 | 7/2021 | Barnholtz et al. | |
| 2021/0237964 | A1 | 8/2021 | Sheehan et al. | |

FOREIGN PATENT DOCUMENTS

| | | | |
|---|---|---|---|
| WO | WO 03/074398 | A1 | 9/2003 |
| WO | WO 2006/083591 | A1 | 8/2006 |
| WO | WO 2006/130284 | A1 | 12/2006 |
| WO | WO 2008/107845 | A2 | 9/2008 |
| WO | WO 2009/078774 | A2 | 6/2009 |
| WO | 2011159732 | A1 | 12/2011 |

* cited by examiner

SANITARY TISSUE PRODUCT ROLLS

FIELD OF THE INVENTION

The present invention relates to sanitary tissue product rolls that exhibit novel combinations of physical properties, such as Moment of Inertia, Roll Density, and Roll Diameter, such that the sanitary tissue product rolls meet consumers' needs, and method for making such novel sanitary tissue product rolls and marketing such novel sanitary tissue product rolls.

BACKGROUND OF THE INVENTION

In the sanitary tissue product industry, there are two categories: 1) At Home sanitary tissue products, for example At Home toilet tissue and At Home paper towels, and 2) Away from Home ("AFH") sanitary tissue products, for example AFH toilet tissue and AFH paper towels. The At Home sanitary tissue products are designed and marketed for consumers' residences for private use in their bathrooms on their existing toilet tissue holders, which oftentimes are built into their homes, and/or in their kitchens or other parts of their homes on their existing paper towel holders. The existing At Home toilet tissue holders are designed to hold prior art toilet tissue rolls up to 6.5 inches in diameter (diameter of roll before first use) sometimes with the use of an adapter and which become problematic if not worthless with toilet tissue rolls having diameters greater than 6.5 inches (diameter of roll before first use). Non-limiting examples of such toilet tissue holders suitable for prior art At Home toilet tissue rolls are shown in Prior Art FIGS. 1A-1C. The existing At Home paper towel holders, like the existing At Home toilet tissue holders, are designed to hold paper towel rolls up to 6.5 inches in diameter (diameter of roll before first use) and which become problematic if not worthless with paper towel rolls having diameters greater than 6.5 inches. Non-limiting examples of such paper towel holders suitable for prior art At Home paper towel rolls are shown in Prior Art FIGS. 2A-2C.

The Away from Home sanitary tissue products are designed and marketed for commercial and industrial purposes such as hotels, restaurants, hospitals, institutions, for example public restrooms, which typically have a significant number of users. Such Away from Home sanitary tissue product rolls are dispensed from specialty dispensers, examples of which are shown in Prior Art FIGS. 3A (AFH toilet tissue dispenser) and 3B-3C (AFH paper towel dispensers), that are typically closed and locked to users and contain sanitary tissue product rolls, for example an AFH toilet tissue roll as shown in FIGS. 4A and 4B and an AFH paper towel roll as shown in FIGS. 5A and 5B, that are not perforated into sheets or at least not entirely perforated such that at least a length of the sanitary tissue product, for example greater than 10 inches and/or greater than 20 inches and/or greater than 100 inches and/or greater than 500 inches and/or the entire length of the sanitary tissue product roll comprises adjacent perforated sheets.

Most of the At Home sanitary tissue product rolls comprise a web, for example a single-ply or multi-ply web, convolutely wrapped about a core having an outer diameter of less than 2.25 inches and/or less than 2.00 inches and/or less than 1.85 inches and/or about 1.25 inches and/or to about 1.5 inches and/or to about 1.7 inches such that the At Home sanitary tissue product rolls are suitable for being received by the spindles of the existing At Home toilet tissue holders and/or existing At Home paper towel holders.

Whereas the AFH sanitary tissue product rolls comprise a web, for example a single-ply or multi-ply web convolutely wrapped about a core having an outer diameter of greater than 2.5 inches and/or greater than 3.0 inches such that the AFH sanitary tissue product rolls are suitable for being received by the existing AFH toilet tissue holders and/or existing AFH paper towel holders.

The prior art Away from Home sanitary tissue product rolls comprise conventional wet pressed (non-structured) webs (fibrous structures), which may be embossed or not embossed. Whereas the prior art At Home sanitary tissue product rolls may comprise one or more webs (fibrous structures) selected from the group consisting of: through-air-dried (creped or uncreped) fibrous structures, belt creped fibrous structures, fabric creped fibrous structures, NTT fibrous structures, ATMOS fibrous structures, conventional wet pressed fibrous structures, and mixtures thereof.

As shown in FIG. 6 and Table 1, prior art toilet tissue rolls designed for use in consumers' homes and on open dispensers, referred to as "Mkt Bath" in FIG. 6 and Table 1, rather than for use in AFH venues, such as public restrooms, have typically exhibited roll diameters of 6.5 inches or less. In addition, as shown in FIG. 6 and Table 1, such prior art toilet tissue rolls have exhibited Moment of Inertia values of 0.65 $g*m^2$ or less as measured according to the Moment of Inertia Test Method described herein.

As shown in FIG. 6 and Table 1, prior art paper towel rolls designed for use in consumers' homes and on open dispensers, referred to as "Mkt Towel" in FIG. 6 and Table 1, rather than for use in away-from-home venues, such as public restrooms, have typically exhibited roll diameters of 6.5 inches or less. In addition, as shown in FIG. 6 and Table 1, such prior art paper towel rolls have exhibited Moment of Inertia values of 1.44 $g*m^2$ or less as measured according to the Moment of Inertia Test Method described herein.

One problem faced by formulators of sanitary tissue product rolls is how to produce sanitary tissue product rolls that exhibit Roll Diameters of greater than 8.25 inches as measured according to the Roll Diameter Test Method described herein, Moment of Inertia values of greater than 1.50 $g*m^2$ as measured according to the Moment of Inertia Test Method described herein, and Roll Density values of less than 2.50 $g/cm^3$ as measured according to the Roll Density Test Method described herein. Formulators have run into the problem of stability of sanitary tissue product rolls, especially toilet tissue rolls, when they attempted to go larger than 6.5 inches in diameter because the sidewalls of the sanitary tissue product can become unstable and cause the sidewalls to "telescope". Still furthermore, formulators may have encountered problems with the stopping the rolling or dampening the rotational momentum/energy of sanitary tissue rolls once a consumer initiates rotation for dispensing of the roll's sheets when the formulator goes to greater than 6.5, such as greater than 8.25 inches in diameter, Moment of Inertia values of greater than 1.50 $g*m^2$ as measured according to the Moment of Inertia Test Method described herein, and Roll Density values of less than 2.50 $g/cm^3$ as measured according to the Roll Density Test Method described herein.

Accordingly, there is a need for sanitary tissue product rolls, for example toilet tissue rolls and/or paper towel rolls, such as At Home toilet tissue rolls and At Home paper towel rolls, that exhibit Roll Diameters of greater than 8.25 inches as measured according to the Roll Diameter Test Method described herein, Moment of Inertia values of greater than 1.50 $g*m^2$ as measured according to the Moment of Inertia Test Method described herein, and Roll Density values of less than 2.50 g/cm$^3$ as measured according to the Roll Density Test Method described herein, that meet consumers' needs, methods for making such sanitary tissue product rolls, packages comprising such sanitary tissue product rolls, and methods for marketing such sanitary tissue product rolls.

Additionally, there is a need for sanitary tissue product rolls, for example toilet tissue rolls and/or paper towel rolls, such as At Home toilet tissue rolls and At Home paper towel rolls, that exhibit Roll Diameters of greater than 6.5 and/or greater than 8.25 inches as measured according to the Roll Diameter Test Method described herein, Moment of Inertia values of greater than 1.50 g*m$^2$ as measured according to the Moment of Inertia Test Method described herein, Roll Density values of less than 2.50 g/cm$^3$ as measured according to the Roll Density Test Method described herein, and a Core Kinetic Coefficient of Friction value of greater than 0.10 and less than 0.50 as measured according to the Core Kinetic Coefficient of Friction Measurement Test Method described herein, that meet consumers' needs, methods for making such sanitary tissue product rolls, packages comprising such sanitary tissue product rolls, and methods for marketing such sanitary tissue product rolls.

SUMMARY OF THE INVENTION

The present invention fulfills the need described above by providing novel sanitary tissue product rolls, for example toilet tissue rolls and/or paper towel rolls, such as At Home toilet tissue rolls and At Home paper towel rolls, that exhibit Roll Diameters of greater than 8.25 inches as measured according to the Roll Diameter Test Method described herein, Moment of Inertia values of greater than 1.50 g*m$^2$ as measured according to the Moment of Inertia Test Method described herein, and Roll Density values of less than 2.50 g/cm$^3$ as measured according to the Roll Density Test Method described herein, methods for making such sanitary tissue product rolls, packages comprising such sanitary tissue product rolls, and methods for marketing such sanitary tissue product rolls.

In one example of the present invention, a sanitary tissue product roll comprising a web, wherein the sanitary tissue product roll exhibits a Roll Diameter of greater than 8.25 inches as measured according to the Roll Diameter Test Method, a Moment of Inertia of greater than 1.50 g*m$^2$ as measured according to the Moment of Inertia Test Method, a Roll Density of less than 0.250 g/cm$^3$ as measured according to the Roll Density Test Method is provided.

In yet another example of the present invention, a sanitary tissue product roll comprising a web, wherein the sanitary tissue product roll exhibits a Roll Diameter of greater than 6.25 and/or greater than 8.25 inches as measured according to the Roll Diameter Test Method, a Moment of Inertia of greater than 1.50 g*m$^2$ as measured according to the Moment of Inertia Test Method, a Roll Density of less than 0.250 g/cm$^3$ as measured according to the Roll Density Test Method, and a Core Kinetic Coefficient of Friction value of greater than 0.10 and less than 0.50 as measured according to the Core Kinetic Coefficient of Friction Measurement Test Method described herein is provided.

In another example of the present invention, a package, for example a film overwrap, such as a polyolefin film wrapper, for example polyethylene film wrapper, comprising one or more sanitary tissue product rolls according to the present invention is provided.

In another example of the present invention, a package, for example a film bag, such as a polyolefin film bag, for example polyethylene film bag, comprising one or more sanitary tissue product rolls according to the present invention is provided.

In yet another example of the present invention, a package, for example a cartonboard, such as a cellulose fiber cartonboard, comprising one or more sanitary tissue product rolls according to the present invention is provided.

In still yet another example of the present invention, a package, for example a corrugated board or cardboard, such as a cellulose fiber corrugated board or cardboard, comprising one or more sanitary tissue product rolls according to the present invention is provided.

In even still another example of the present invention, a package comprising one or more sanitary tissue product rolls according to the present invention, wherein the package comprises one or more and/or two or more and/or three or more and/or four or more materials selected from the group consisting of: 1) a film overwrap, such as a polyolefin film wrapper, for example a polyethylene film wrapper; 2) a film bag, such as a polyolefin film bag, for example a polyethylene film bag; 3) a cartonboard, such as a cellulose fiber cartonboard; 4) a corrugated board or cardboard, such as cellulose fiber corrugated board or cardboard; and 5) combinations thereof is provided.

In even yet another example of the present invention, a plastic-free package, such as a cartonboard, such as a cellulose fiber cartonboard, and/or a corrugated board or cardboard, such as cellulose fiber corrugated board or cardboard; and 5) combinations thereof is provided.

In yet another example of the present invention, a method for making a sanitary tissue product roll, wherein the method comprises the steps of:

a. providing a web;

b. convolutely winding the web, for example about a core, such that a sanitary tissue product roll according to the present invention is formed is provided.

In still another example of the present invention, a method for marketing a sanitary tissue product roll according to the present invention, wherein the method comprises the step of providing an image of the sanitary tissue product roll on a user's computer such that the user can purchase the sanitary tissue product roll is provided. The method may further comprise delivering the purchased sanitary tissue product roll from a source of the sanitary tissue product roll, for example an online distributer and/or online marketer, such as Amazon, and/or from a manufacturer of the sanitary tissue product roll.

In still another example of the present invention, a method for marketing a sanitary tissue product roll according to the present invention, wherein the method comprises the step of delivering a package comprising one or more sanitary tissue product rolls to a consumer in response to an order, for example an online order, submitted by the consumer.

In even still another example of the present invention, a method for marketing a sanitary tissue product roll according to the present invention, wherein the method comprises delivering, directly and/or indirectly, one or more packages comprising one or more sanitary tissue product rolls according to the present invention to a retailer for selling to consumers, is provided.

The present invention provides novel sanitary tissue product rolls that exhibit Roll Diameters of greater than 8.25 inches as measured according to the Roll Diameter Test Method described herein, Moment of Inertia values of greater than 1.50 g*m$^2$ as measured according to the Moment of Inertia Test Method described herein, and Roll Density values of less than 2.50 g/cm$^3$ as measured according to the Roll Density Test Method described herein, methods for making such sanitary tissue product rolls, packages comprising such sanitary tissue product rolls, and methods for marketing such sanitary tissue product rolls.

The present invention further provides novel sanitary tissue product rolls that exhibit Roll Diameters of greater than 6.25 and/or greater than 8.25 inches as measured according to the Roll Diameter Test Method described herein, Moment of Inertia values of greater than 1.50 $g*m^2$ as measured according to the Moment of Inertia Test Method described herein, Roll Density values of less than 2.50 $g/cm^3$ as measured according to the Roll Density Test Method described herein, and a Core Kinetic Coefficient of Friction value of greater than 0.10 and less than 0.50 as measured according to the Core Kinetic Coefficient of Friction Measurement Test Method described herein, methods for making such sanitary tissue product rolls, packages comprising such sanitary tissue product rolls, and methods for marketing such sanitary tissue product rolls.

DETAILED DESCRIPTION OF THE INVENTION

Definitions

Figure 7:
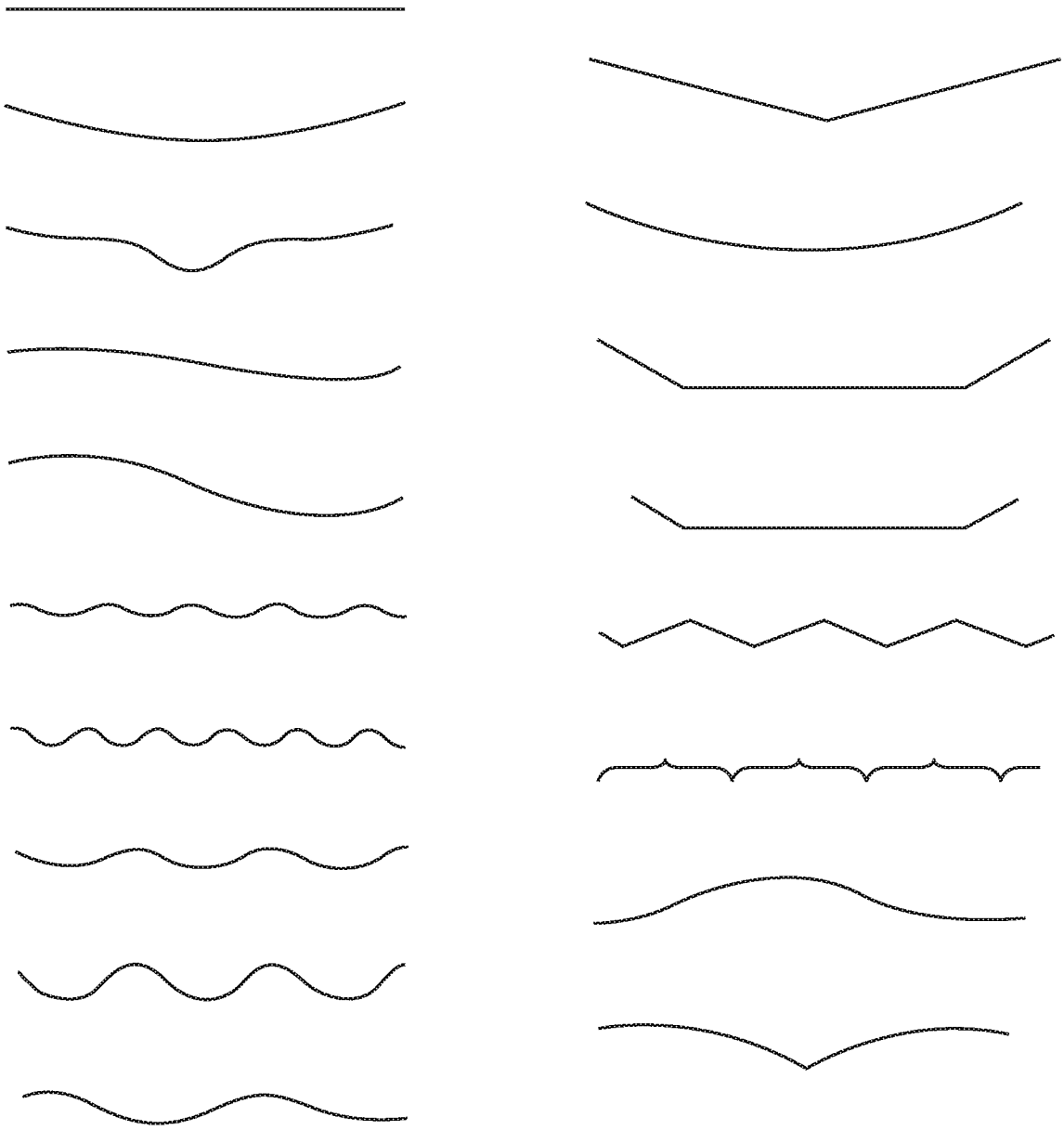
FIG. 7 is an example of general shapes of perforation lines suitable for use in the sanitary tissue product rolls of the present invention.

"Sanitary tissue product roll" as used herein means a roll of sanitary tissue product. The sanitary tissue product roll and thus the sanitary tissue product comprises a web convolutely wound, for example about a core, in the form of a roll. The core may comprise a wound and overlapping tube of one or more layers comprised of paperboard or other flexible materials, a wooden, metal, glass, plastic, or other composite material sleeve, or an extruded thermoplastic resin. The web may be adhered to the core or wound on the core without adhering to the core. The core may exhibit an outer diameter of less than 2.25 inches and/or less than 2.00 inches and/or less than 1.85 inches and/or less than 2.25 inches to about 1.25 inches and/or less than 2.00 inches to about 1.50 inches and/or less than 1.85 inches to about 1.50 inches. The web may comprise one (a single-ply) or more (a multi-ply) fibrous structure plies, for example two or more fibrous structure plies and/or three or more fibrous structure plies. Such sanitary tissue product rolls may comprise a plurality of connected, but perforated sheets of sanitary tissue product (web) that are separably dispensable from adjacent sheets, for example via one or more perforations, for example a plurality of perforations within the sanitary tissue product (web). The perforations in the sanitary tissue products of the present invention may be straight and/or shaped perforation lines examples of general shapes of such perforation lines (areas or lines of weakness in the sanitary tissue product or web) are shown in FIG. 7 and may be extend in the cross-machine direction (CD) and optionally, in the machine direction (MD) and/or diagonally between the CD and MD.

"Sanitary tissue product", which may be referred to herein as a "web", as used herein means a soft, low density (i.e. <about 0.15 $g/cm^3$) article comprising a web comprising one or more fibrous structure plies according to the present invention, wherein the sanitary tissue product is useful as a wiping implement for post-urinary and post-bowel movement cleaning (toilet tissue), for otorhinolaryngological discharges (facial tissue), and multi-functional absorbent and cleaning uses (absorbent towels).

In one example, the sanitary tissue product is a toilet tissue product (toilet tissue), for example a toilet tissue product that is designed to be flushed down toilets, for example residential toilets, such as tank-type toilets, and to disperse within municipal sewer systems and/or septic systems/tanks. Such a toilet tissue product is void of permanent wet strength and/or levels of permanent wet strength agents, for example polyaminoamide-epichlorohydrin (PAE), which would negatively impact the toilet tissue's decay such that the toilet tissue would exhibit a wet strength decay of 25% or less, more typically a wet strength decay of only about 10-15% during a 30 minute soak test. Such a wet strength decay of 25% or less (typically 10-15%) is unacceptable and undesirable for toilet tissue, which is designed to be flushed down toilets and into septic systems/tanks and/or municipal sewer systems. However, the toilet tissue may comprise a temporary wet strength agent such that the toilet tissue exhibits enough wet strength (temporary wet strength) to meet consumer requirements (doesn't fall apart and/or disperse and/or leak through) during use, for example during the brief time the toilet tissue is wet during use and/or exposed to a relatively small amount of water (not saturated) by a consumer (during wiping, for example after urinating), without causing the toilet tissue to exhibit flushability issues compared to the flushability issues a toilet tissue exhibiting permanent wet strength would encounter. In one example, the toilet tissue of the present invention exhibits a wet strength decay of greater than 60% during a 30 minute soak test (and typically even a wet strength decay of at least 40-60% after 2 minutes during the 30 minute soak test), which is considered "temporary wet strength", due to the concerns of flushability issues. Temporary wet strength in paper, for example toilet issue, is achieved by adding temporary wet strength agents, for example glyoxylated polyacrylamide, to the toilet tissue.

In another example, the sanitary tissue product is a paper towel product (paper towel), for example a paper towel product designed to absorb fluids, such as water, while still remaining intact (not dispersing). Paper towel products are designed to not be flushed down toilets and/or to not disperse when wet. Such a paper towel product exhibits permanent wet strength and/or comprises levels of permanent wet strength agents, for example polyaminoamide-epichlorohydrin (PAE), which result in the paper towel's exhibiting a wet strength decay of 25% or less, more typically a wet strength decay of only about 10-15% during a 30 minute soak test.

Toilet tissue that exhibits temporary wet strength when disposed in a toilet due to the toilet bowl's water begins decaying, breaking apart into pieces, and dispersing upon saturation of the toilet tissue. Paper towels, which exhibit permanent wet strength, are not suitable to be flushed in toilets because unlike toilet tissue, which exhibits temporary wet strength, paper towels will not decay, break apart into pieces, and disperse upon saturation of the paper towel resulting in the toilet being clogged and/or pipes, septic tank, and municipal sewer systems being "clogged" by the intact paper towel. One reason paper towels require permanent wet strength is that consumers may reuse and rewet a paper towel during use. As result of the issues associated with having permanent wet strength in toilet tissue (bath tissue), one of ordinary skill in the art understands that all bath tissue grades should never include a level of permanent wet strength agent that would result in the toilet tissue (bath tissue) exhibiting permanent wet strength and thus resulting in flushability issues, such as issues with dispersing and/or very low wet strength decay properties.

The sanitary tissue products of the present invention may exhibit a basis weight of greater than 15 g/m$^2$ to about 120 g/m$^2$ and/or from about 15 g/m$^2$ to about 110 g/m$^2$ and/or from about 20 g/m$^2$ to about 100 g/m$^2$ and/or from about 30 to 90 g/m$^2$ as measured according to the respective Basis Weight Test Method described herein. In addition, the sanitary tissue products and/or fibrous structures of the present invention may exhibit a basis weight between about 40 g/m$^2$ to about 120 g/m$^2$ and/or from about 50 g/m$^2$ to about 110 g/m$^2$ and/or from about 55 g/m$^2$ to about 105 g/m$^2$ and/or from about 60 to 100 g/m$^2$ as measured according to the respective Basis Weight Test Method described herein.

The sanitary tissue products, for example toilet tissue products, of the present invention may exhibit a sum of MD and CD dry tensile strength of greater than about 59 g/cm (150 g/in) and/or from about 78 g/cm to about 394 g/cm and/or from about 98 g/cm to about 335 g/cm as measured according to the respective Dry Tensile Strength Test Method described herein. In addition, the sanitary tissue products, for example toilet tissue products, of the present invention may exhibit a sum of MD and CD dry tensile strength of greater than about 196 g/cm and/or from about 196 g/cm to about 394 g/cm and/or from about 216 g/cm to about 335 g/cm and/or from about 236 g/cm to about 315 g/cm as measured according to the respective Dry Tensile Strength Test Method described herein. In one example, the sanitary tissue products, for example toilet tissue products, of the present invention exhibit a sum of MD and CD dry tensile strength of less than about 394 g/cm and/or less than about 335 g/cm as measured according to the respective Dry Tensile Strength Test Method described herein.

In another example, the sanitary tissue products, for example paper towel products, of the present invention may exhibit a sum of MD and CD dry tensile strength of greater than about 196 g/cm and/or greater than about 236 g/cm and/or greater than about 276 g/cm and/or greater than about 315 g/cm and/or greater than about 354 g/cm and/or greater than about 394 g/cm and/or from about 315 g/cm to about 1968 g/cm and/or from about 354 g/cm to about 1181 g/cm and/or from about 354 g/cm to about 984 g/cm and/or from about 394 g/cm to about 787 g/cm as measured according to the respective Dry Tensile Strength Test Method described herein.

The sanitary tissue products, for example toilet tissue products, of the present invention may exhibit an initial sum of MD and CD wet tensile strength of less than about 78 g/cm and/or less than about 59 g/cm and/or less than about 39 g/cm and/or less than about 29 g/cm as measured according to the Wet Tensile Test Method described herein.

The sanitary tissue products, for example paper towel products, of the present invention may exhibit an initial sum of MD and CD wet tensile strength of greater than about 118 g/cm and/or greater than about 157 g/cm and/or greater than about 196 g/cm and/or greater than about 236 g/cm and/or greater than about 276 g/cm and/or greater than about 315 g/cm and/or greater than about 354 g/cm and/or greater than about 394 g/cm and/or from about 118 g/cm to about 1968 g/cm and/or from about 157 g/cm to about 1181 g/cm and/or from about 196 g/cm to about 984 g/cm and/or from about 196 g/cm to about 787 g/cm and/or from about 196 g/cm to about 591 g/cm as measured according to the Wet Tensile Test Method described herein.

The sanitary tissue products of the present invention may exhibit a density (based on measuring caliper at 95 g/in$^2$), which may be referred to as a sheet density or web density to distinguish it from the sanitary tissue product roll's Roll Density, of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The sanitary tissue products of the present invention may comprise additives such as surface softening agents, for example silicones, quaternary ammonium compounds, aminosilicones, lotions, and mixtures thereof, temporary wet strength agents, permanent wet strength agents, bulk softening agents, wetting agents, latexes, especially surface-pattern-applied latexes, dry strength agents such as carboxymethylcellulose and starch, and other types of additives suitable for inclusion in and/or on sanitary tissue products.

In one example, the sanitary tissue products, for example paper towel products, of the present invention exhibits permanent wet strength, for example the sanitary tissue products comprise a permanent wet strength agent, such as a level of permanent wet strength agent such that the sanitary tissue products exhibit a wet strength decay of less than 25% and/or less than 20% and/or less than 15% and/or from about 5% to about 25% and/or from about 5% to about 20% and/or from about 10% to about 15% during a 30 minute soak test.

In one example, the sanitary tissue products, for example toilet tissue products, of the present invention are void of permanent wet strength, for example the sanitary tissue products exhibit a wet strength decay of greater than 60% and/or greater than 65% and/or greater than 70% and/or greater than 75% and/or greater than 80% during a 30 minute soak test and/or greater than 40% and/or greater than 45% and/or greater than 50% and/or greater than 55% and/or greater than 60% after 2 minutes during the 30 minute soak test. In one example, the sanitary tissue products, for example toilet tissue products, comprise a temporary wet strength agent, for example a level of temporary wet strength agent, such that the sanitary tissue products exhibit the wet strength decay described immediately above.

"Web" and/or "fibrous structure" and/or "fibrous structure ply" as used herein means a structure that comprises a plurality of pulp fibers. In one example, the fibrous structure may comprise a plurality of wood pulp fibers. In another example, the fibrous structure may comprise a plurality of non-wood pulp fibers, for example plant fibers, synthetic staple fibers, and mixtures thereof. In still another example, in addition to pulp fibers, the fibrous structure may comprise a plurality of filaments, such as polymeric filaments, for example thermoplastic filaments such as polyolefin filaments (i.e., polypropylene filaments) and/or hydroxyl polymer filaments, for example polyvinyl alcohol filaments and/or polysaccharide filaments such as starch filaments. In one example, a fibrous structure according to the present invention means an orderly arrangement of fibers alone and with filaments within a structure in order to perform a function. Non-limiting examples of fibrous structures of the present invention include paper.

Non-limiting examples of processes for making fibrous structures include known wet-laid papermaking processes, for example conventional wet-pressed papermaking processes and through-air-dried papermaking processes, and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous slurry is then used to deposit a plurality of fibers onto a forming wire, fabric, or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, often referred to as a parent roll, and may subsequently be converted into a finished product, e.g. a single- or multi-ply sanitary tissue product.

The fibrous structures of the present invention may be homogeneous or may be layered. If layered, the fibrous structures may comprise at least two and/or at least three and/or at least four and/or at least five layers of fiber and/or filament compositions.

In one example, the fibrous structure of the present invention consists essentially of fibers, for example pulp fibers, such as cellulosic pulp fibers and more particularly wood pulp fibers, such as 100% of the fibers present in the fibrous structure are pulp fibers, such as cellulosic pulp fibers and more particularly wood pulp fibers.

In another example, the fibrous structure of the present invention comprises fibers and is void of filaments.

In still another example, the fibrous structures of the present invention comprise filaments and fibers, such as a co-formed fibrous structure.

"Co-formed fibrous structure" as used herein means that the fibrous structure comprises a mixture of at least two different materials wherein at least one of the materials comprises a filament, such as a polypropylene filament, and at least one other material, different from the first material, comprises a solid additive, such as a fiber and/or a particulate. In one example, a co-formed fibrous structure comprises solid additives, such as fibers, such as wood pulp fibers, and filaments, such as polypropylene filaments.

"Fiber" and/or "Filament" as used herein means an elongate particulate having an apparent length greatly exceeding its apparent width, i.e. a length to diameter ratio of at least about 10. In one example, a "fiber" is an elongate particulate as described above that exhibits a length of less than 5.08 cm (2 in.) and a "filament" is an elongate particulate as described above that exhibits a length of greater than or equal to 5.08 cm (2 in.).

Fibers are typically considered discontinuous in nature. Non-limiting examples of fibers include pulp fibers, such as wood pulp fibers, and synthetic staple fibers such as polyester fibers.

Filaments are typically considered continuous or substantially continuous in nature. Filaments are relatively longer than fibers. Non-limiting examples of filaments include meltblown and/or spunbond filaments. Non-limiting examples of materials that can be spun into filaments include natural polymers, such as starch, starch derivatives, cellulose and cellulose derivatives, hemicellulose, hemicellulose derivatives, and synthetic polymers including, but not limited to polyvinyl alcohol filaments and/or polyvinyl alcohol derivative filaments, and thermoplastic polymer filaments, such as polyesters, nylons, polyolefins such as polypropylene filaments, polyethylene filaments, and biodegradable or compostable thermoplastic fibers such as polylactic acid filaments, polyhydroxyalkanoate filaments and polycaprolactone filaments. The filaments may be monocomponent or multicomponent, such as bicomponent filaments.

In one example of the present invention, "fiber" refers to papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified fibrous structure. U.S. Pat. Nos. 4,300,981 and 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking In one example, the wood pulp fibers are selected from the group consisting of hardwood pulp fibers, softwood pulp fibers, and mixtures thereof. The hardwood pulp fibers may be selected from the group consisting of: tropical hardwood pulp fibers, northern hardwood pulp fibers, and mixtures thereof. The tropical hardwood pulp fibers may be selected from the group consisting of: eucalyptus fibers, acacia fibers, and mixtures thereof. The northern hardwood pulp fibers may be selected from the group consisting of: cedar fibers, maple fibers, and mixtures thereof.

In addition to the various wood pulp fibers, other cellulosic fibers such as cotton linters, rayon, lyocell, trichomes, seed hairs, and bagasse can be used in this invention. Other sources of cellulose in the form of fibers or capable of being spun into fibers include grasses and grain sources.

"Trichome" or "trichome fiber" as used herein means an epidermal attachment of a varying shape, structure and/or function of a non-seed portion of a plant. In one example, a trichome is an outgrowth of the epidermis of a non-seed portion of a plant. The outgrowth may extend from an epidermal cell. In one embodiment, the outgrowth is a trichome fiber. The outgrowth may be a hairlike or bristle-like outgrowth from the epidermis of a plant.

Trichome fibers are different from seed hair fibers in that they are not attached to seed portions of a plant. For example, trichome fibers, unlike seed hair fibers, are not attached to a seed or a seed pod epidermis. Cotton, kapok, milkweed, and coconut coir are non-limiting examples of seed hair fibers.

Further, trichome fibers are different from nonwood bast and/or core fibers in that they are not attached to the bast, also known as phloem, or the core, also known as xylem portions of a nonwood dicotyledonous plant stem. Non-limiting examples of plants which have been used to yield nonwood bast fibers and/or nonwood core fibers include kenaf, jute, flax, ramie and hemp.

Further trichome fibers are different from monocotyledonous plant derived fibers such as those derived from cereal straws (wheat, rye, barley, oat, etc.), stalks (corn, cotton, sorghum, Hesperaloe funifera, etc.), canes (bamboo, bagasse, etc.), grasses (esparto, lemon, sabai, switchgrass, etc), since such monocotyledonous plant derived fibers are not attached to an epidermis of a plant.

Further, trichome fibers are different from leaf fibers in that they do not originate from within the leaf structure. Sisal and abaca are sometimes liberated as leaf fibers.

Finally, trichome fibers are different from wood pulp fibers since wood pulp fibers are not outgrowths from the epidermis of a plant; namely, a tree. Wood pulp fibers rather originate from the secondary xylem portion of the tree stem.

"Basis Weight" as used herein is the weight per unit area of a sample reported in lbs/3000 $ft^2$ or $g/m^2$ (gsm) and is measured according to the respective Basis Weight Test Method described herein.

"Machine Direction" or "MD" as used herein means the direction parallel to the flow of the fibrous structure through the web (fibrous structure) making machine and/or sanitary tissue product manufacturing equipment.

"Cross Machine Direction" or "CD" as used herein means the direction parallel to the width of the web (fibrous structure) making machine and/or sanitary tissue product manufacturing equipment and perpendicular to the machine direction.

"Ply" as used herein means an individual, integral web (fibrous structure).

"Plies" as used herein means two or more individual, integral webs (fibrous structures) disposed in a substantially contiguous, face-to-face relationship with one another, forming a multi-ply fibrous structure and/or multi-ply sanitary tissue product. It is also contemplated that an individual, integral web (fibrous structure) can effectively form a multi-ply fibrous structure, for example, by being folded on itself.

"Embossed" as used herein with respect to a web and/or sanitary tissue product means that a web and/or sanitary tissue product of the present invention has been subjected to a process which converts a smooth surfaced web and/or sanitary tissue product to a decorative surface by replicating a design on one or more emboss rolls, which form a nip through which the web and/or sanitary tissue product passes. Embossed does not include creping, microcreping, printing or other processes that may also impart a texture and/or decorative pattern to a web and/or sanitary tissue product.

"Differential density", as used herein, means a web and/or sanitary tissue product of the present invention that comprises one or more regions of relatively low fiber density, which are referred to as pillow regions, and one or more regions of relatively high fiber density, which are referred to as knuckle regions.

"Densified", as used herein means a portion of a web and/or sanitary tissue product of the present invention that is characterized by regions of relatively high fiber density (knuckle regions).

"Non-densified", as used herein, means a portion of a web and/or sanitary tissue product of the present invention that exhibits a lesser density (one or more regions of relatively lower fiber density) (pillow regions) than another portion (for example a knuckle region) of the web and/or sanitary tissue product.

"Creped" as used herein means creped off of a Yankee dryer or other similar roll and/or fabric creped and/or belt creped. Rush transfer of a web (fibrous structure) alone does not result in a "creped" fibrous structure or "creped" sanitary tissue product for purposes of the present invention.

Sanitary Tissue Product Rolls

The sanitary tissue product rolls of the present invention may comprise a single-ply web (a single fibrous structure ply) or multi-ply web (two or more and/or three or more fibrous structure plies that may be adhesively bonded together, for example via plybond glue, and/or mechanically bonded together, for example via a knurling wheel). The webs (fibrous structures) and/or sanitary tissue products of the present invention are made from a plurality of pulp fibers, for example wood pulp fibers and/or other cellulosic pulp fibers, for example trichomes. In addition to the pulp fibers, the webs and/or sanitary tissue products of the present invention may comprise synthetic fibers and/or filaments.

In one example, the sanitary tissue product rolls 10 of the present invention exhibit a roll width of less than 12.0 inches and/or less than 11.0 inches and/or less than 10.0 inches and/or less than 9.0 inches and/or less than 8.0 inches and/or less than 7.0 inches and/or less than 6.0 inches and/or less than 5.0 inches and/or less than 4.5 inches and/or less than 4.0 inches and/or greater than 1.0 inches and/or greater than 2.0 inches and/or greater than 3.0 inches and/or greater than 3.5 inches. In one example, the sanitary tissue products forming the sanitary tissue product rolls exhibit widths, for example CD widths, of less than 12.0 inches and/or less than 11.0 inches and/or less than 10.0 inches and/or less than 9.0 inches and/or less than 8.0 inches and/or less than 7.0 inches and/or less than 6.0 inches and/or less than 5.0 inches and/or less than 4.5 inches and/or less than 4.0 inches and/or greater than 1.0 inches and/or greater than 2.0 inches and/or greater than 3.0 inches and/or greater than 3.5 inches.

In one example, the sanitary tissue product rolls, for example paper towel product rolls, exhibit a roll width of less than 12.0 inches and/or at least 8.0 inches and/or greater than 9.0 inches and/or greater than 10.0 inches and/or from about 11.0 inches to less than 12.0 inches. In one example, the sanitary tissue products, for example paper towel products, forming the sanitary tissue product rolls exhibit widths, for example CD widths, of less than 12.0 inches and/or at least 8.0 inches and/or greater than 9.0 inches and/or greater than 10.0 inches and/or from about 11.0 inches to less than 12.0 inches.

Figure 6:
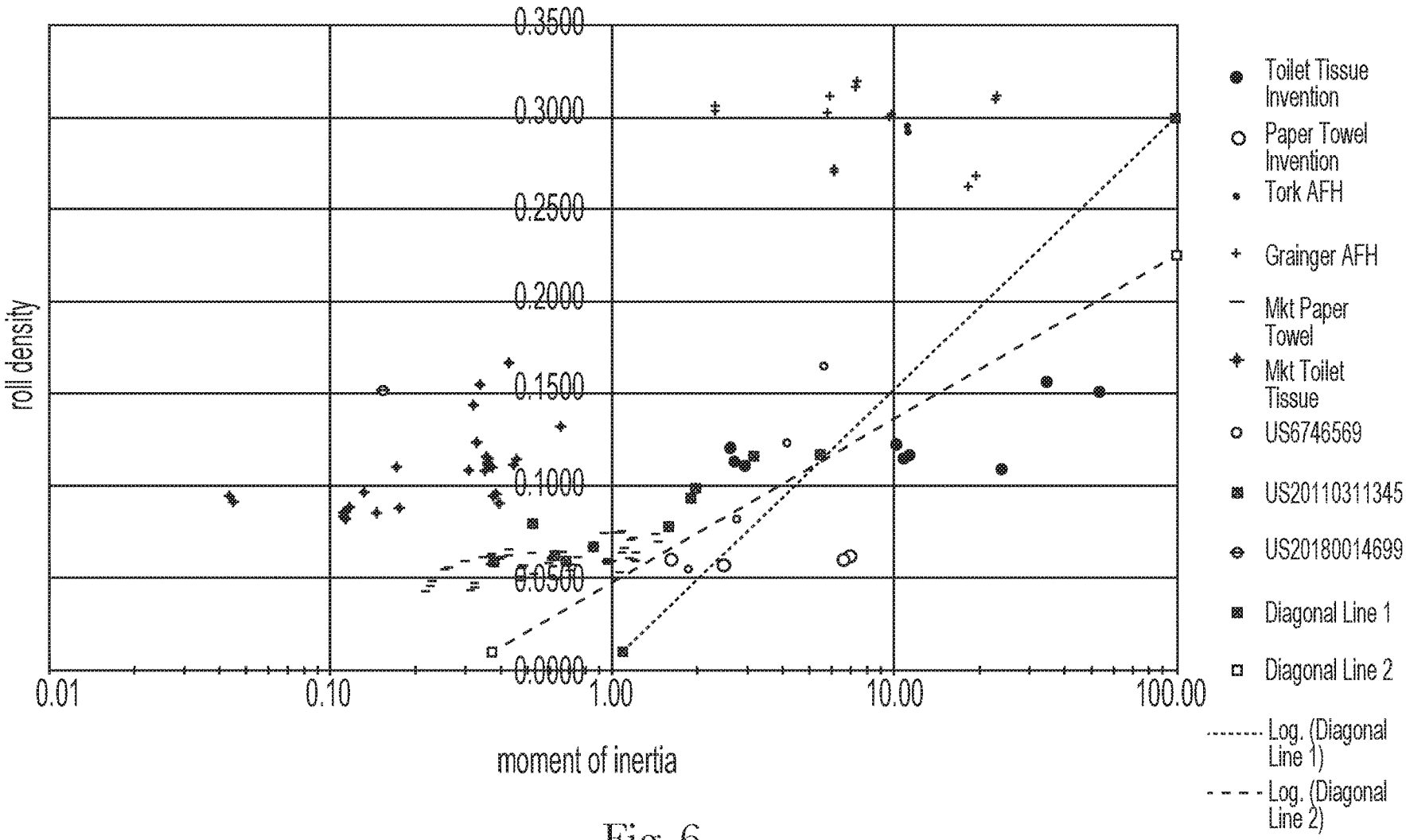
FIG. 6 is a plot of Moment of Inertia in units of $g*m^2$ in log scale as measured according to the Moment of Inertia Test Method described herein on the x-axis and Roll Density in units of $g/cm^3$ as measured according to the Roll Density Test Method described herein on the y-axis for sanitary tissue product rolls of the present invention and prior art sanitary tissue product rolls. The plot contains two lines, a Diagonal Line 1 defined by the equation $y=0.0643\log(x)+0.0039$ and a Diagonal 2 defined by the equation $y=0.0385\log(x)+0.0478$.

As shown in FIG. 6 and Table 1 below, which contains a portion of the data values represented in FIG. 6, the sanitary tissue product rolls of the present invention exhibit a novel combination of Roll Diameter values as measured according to the Roll Diameter Test Method described herein, Moment of Inertia values as measured according to the Moment of Inertia Test Method described herein, and/or Roll Density values as measured according to the Roll Density Test Method described herein that are novel over known sanitary tissue product rolls.

TABLE 1

| Roll | Plies | Type | Product | Core | Outer Diameter of Core (inches) |
|---|---|---|---|---|---|
| Invention-Ex. 1A | 2 | TAD | Toilet Tissue | Y | 1.63 |
| Invention-Ex 1B | 2 | TAD | Toilet Tissue | Y | 1.63 |
| Invention-Ex. 1C | 2 | TAD | Toilet Tissue | Y | 1.63 |
| Invention-Ex. 1D | 2 | TAD | Toilet Tissue | Y | 1.63 |
| Invention-Ex. 1E | 2 | TAD | Toilet Tissue | Y | 1.63 |
| Invention-Ex. 1F | 2 | TAD | Toilet Tissue | Y | 1.63 |
| Invention-Ex. 1G | 2 | TAD | Toilet Tissue | Y | 1.65 |
| Invention-Ex. 1H | 2 | TAD | Toilet Tissue | Y | 1.65 |
| Invention-Ex. 1I | 2 | TAD | Toilet Tissue | Y | 1.65 |
| Invention-Ex. 1J | 2 | TAD | Toilet Tissue | Y | 1.65 |
| Invention-Ex. 1K | 2 | TAD | Toilet Tissue | Y | 1.65 |
| Invention-Ex. 2A | 2 | TAD | Paper Towel | Y | 1.63 |
| Invention-Ex. 2B | 2 | TAD | Paper Towel | Y | 1.65 |
| Invention-Ex. 2C | 2 | TAD | Paper Towel | Y | 1.65 |
| Invention-Ex. 2D | 2 | TAD | Paper Towel | Y | 1.65 |
| US 2011/0311345-6 | 2 | TAD | Paper Towel | Y | 1.7 |
| US 2011/0311345-8 | 2 | TAD | Paper Towel | Y | 1.7 |
| US 2011/0311345-9 | 2 | TAD | Paper Towel | Y | 1.7 |
| US 2011/0311345-10 | 2 | TAD | Paper Towel | Y | 1.7 |
| US 2011/0311345-11 | 2 | TAD | Paper Towel | Y | 1.7 |
| US 2011/0311345-12 | 2 | TAD | Paper Towel | Y | 1.7 |
| U.S. Pat. No. 6,746,569-4A | — | TAD | Paper Towel | Y | 1.5 |
| U.S. Pat. No. 6,746,569-4B | — | TAD | Paper Towel | Y | 1.5 |
| U.S. Pat. No. 6,746,569-5 | — | TAD | Paper Towel | Y | 1.5 |
| U.S. Pat. No. 6,746,569-6 | — | TAD | Paper Towel | Y | 1.5 |
| Tork AFH | 2 | CWP | Toilet Tissue | Y | 2.3 |
| Tork AFH | 2 | CWP | Toilet Tissue | Y | 2.3 |
| Grainger AFH | 1 | CWP | Toilet Tissue | Y | 3.3 |
| Grainger AFH | 1 | CWP | Toilet Tissue | Y | 3.3 |
| Grainger AFH | 2 | CWP | Toilet Tissue | Y | 3.3 |
| Grainger AFH | 2 | CWP | Toilet Tissue | Y | 3.3 |
| Grainger AFH | 1 | CWP | Toilet Tissue | Y | 3.2 |
| Grainger AFH | 1 | CWP | Toilet Tissue | Y | 3.2 |
| Grainger AFH | 1 | CWP | Paper Towel | Y | 2.0 |
| Grainger AFH | 1 | CWP | Paper Towel | Y | 2.0 |
| Grainger AFH | 1 | CWP | Paper Towel | Y | 2.0 |
| Grainger AFH | 1 | CWP | Paper Towel | Y | 2.0 |
| Grainger AFH | 1 | CWP | Paper Towel | Y | 2.0 |
| Grainger AFH | 1 | CWP | Paper Towel | Y | 2.0 |
| Mkt Bath | 2 | TAD | Toilet Tissue | Y | 1.69 |
| Mkt Towel | 2 | TAD | Paper Towel | Y | 1.69 |
| Mkt Towel | 2 | TAD | Paper Towel | Y | 1.69 |
| Mkt Towel | 2 | TAD | Paper Towel | Y | 1.69 |

| Roll | Creped | Embossed | Moment of Inertia ($g * m^2$) | Roll Diameter (inches) | Roll Width (inches) | Roll Density ($g/cm^3$) |
|---|---|---|---|---|---|---|
| Invention-Ex. 1A | Y | Y | 2.60 | 8.52 | 3.94 | 0.121 |
| Invention-Ex 1B | Y | Y | 2.69 | 8.75 | 3.94 | 0.113 |
| Invention-Ex. 1C | Y | Y | 10.26 | 11.97 | 3.94 | 0.122 |
| Invention-Ex. 1D | Y | Y | 10.89 | 12.33 | 3.94 | 0.115 |
| Invention-Ex. 1E | Y | Y | 34.84 | 15.29 | 3.94 | 0.156 |
| Invention-Ex. 1F | Y | Y | 53.45 | 17.17 | 3.94 | 0.151 |

TABLE 1-continued

| | | | | | | |
|---|---|---|---|---|---|---|
| Invention-Ex. 1G | Y | Y | 2.92 | 8.97 | 3.94 | 0.110 |
| Invention-Ex. 1H | Y | Y | 2.92 | 8.95 | 3.94 | 0.111 |
| Invention-Ex. 1I | Y | Y | 10.91 | 12.21 | 4.10 | 0.116 |
| Invention-Ex. 1J | Y | Y | 11.25 | 12.27 | 4.10 | 0.117 |
| Invention-Ex. 1K | Y | Y | 23.67 | 15.18 | 3.94 | 0.109 |
| Invention-Ex. 2A | Y | Y | 6.67 | 9.95 | 11.00 | 0.060 |
| Invention-Ex. 2B | Y | Y | 1.63 | 7.01 | 11.00 | 0.059 |
| Invention-Ex. 2C | Y | Y | 2.52 | 7.92 | 11.00 | 0.056 |
| Invention-Ex. 2D | Y | Y | 6.99 | 10.03 | 11.00 | 0.061 |
| US 2011/0311345-6 | Y | Y | 1.90 | 6.5 | 11 | 0.093 |
| US 2011/0311345-8 | Y | Y | 1.99 | 6.5 | 11 | 0.098 |
| US 2011/0311345-9 | Y | Y | 3.17 | 7 | 11 | 0.116 |
| US 2011/0311345-10 | Y | Y | 3.17 | 7 | 11 | 0.116 |
| US 2011/0311345-11 | Y | Y | 5.46 | 8 | 11 | 0.117 |
| US 2011/0311345-12 | Y | Y | 5.46 | 8 | 11 | 0.117 |
| U.S. Pat. No. 6,746,569-4A | N | N | 1.88 | 8 | 8 | 0.055 |
| U.S. Pat. No. 6,746,569-4B | N | N | 2.78 | 8 | 8 | 0.082 |
| U.S. Pat. No. 6,746,569-5 | N | N | 4.17 | 8 | 8 | 0.123 |
| U.S. Pat. No. 6,746,569-6 | N | N | 5.61 | 8 | 8 | 0.165 |
| Tork AFH | Y | N | 11.16 | 9.02 | 10.08 | 0.295 |
| Tork AFH | Y | N | 11.26 | 8.97 | 10.13 | 0.293 |
| Grainger AFH | Y | Y | 23.14 | 11.97 | 3.51 | 0.312 |
| Grainger AFH | Y | Y | 22.93 | 11.96 | 3.52 | 0.309 |
| Grainger AFH | Y | Y | 19.62 | 11.94 | 3.49 | 0.268 |
| Grainger AFH | Y | Y | 18.40 | 11.89 | 3.39 | 0.263 |
| Grainger AFH | Y | Y | 7.40 | 8.97 | 3.50 | 0.320 |
| Grainger AFH | Y | Y | 7.29 | 8.97 | 3.48 | 0.317 |
| Grainger AFH | Y | Y | 6.16 | 8.92 | 3.53 | 0.270 |
| Grainger AFH | Y | Y | 6.18 | 8.91 | 3.54 | 0.272 |
| Grainger AFH | Y | Y | 2.33 | 5.55 | 7.84 | 0.306 |
| Grainger AFH | Y | Y | 2.31 | 5.54 | 7.91 | 0.303 |
| Grainger AFH | Y | Y | 5.93 | 6.97 | 7.84 | 0.312 |
| Grainger AFH | Y | Y | 5.83 | 6.98 | 7.87 | 0.303 |
| Grainger AFH | Y | Y | 9.70 | 7.96 | 7.80 | 0.300 |
| Grainger AFH | Y | Y | 9.86 | 7.96 | 7.87 | 0.302 |
| Mkt Bath | Y | Y | 0.65 | 5.75 | 4.27 | 0.131 |
| Mkt Towel | Y | Y | 1.06 | 6.42 | 11 | 0.053 |
| Mkt Towel | Y | Y | 1.14 | 6.34 | 11 | 0.060 |
| Mkt Towel | Y | Y | 1.44 | 6.50 | 11 | 0.069 |

| Roll | Sheet Count | Sheet Length (inches) | Regular Perforations | Basis Weight (gsm) |
|---|---|---|---|---|
| Invention-Ex. 1A | — | 4 | Y | 48 |
| Invention-Ex 1B | — | 4 | Y | 48 |
| Invention-Ex. 1C | — | 4 | Y | 48 |
| Invention-Ex. 1D | — | 4 | Y | 48 |
| Invention-Ex. 1E | — | 4 | Y | 48 |
| Invention-Ex. 1F | — | 4 | Y | 48 |
| Invention-Ex. 1G | 850 | 4 | Y | 48 |
| Invention-Ex. 1H | 850 | 4 | Y | 48 |
| Invention-Ex. 1I | 1700 | 4 | Y | 48 |
| Invention-Ex. 1J | 1700 | 4 | Y | 48 |
| Invention-Ex. 1K | 2550 | 4 | Y | 48 |
| Invention-Ex. 2A | — | 10.2 | Y | 55 |
| Invention-Ex. 2B | — | 10.2 | Y | 55 |
| Invention-Ex. 2C | — | 10.2 | Y | 55 |
| Invention-Ex. 2D | — | 10.2 | Y | 55 |
| US 2011/0311345 | 154 | 10.48 | Y | 46 |
| US 2011/0311345 | 282 | 6 | Y | 46 |
| US 2011/0311345 | 180 | 10.4 | Y | 57 |
| US 2011/0311345 | 312 | 6 | Y | 57 |
| US 2011/0311345 | 240 | 10.4 | Y | 57 |
| US 2011/0311345 | 416 | 6 | Y | 57 |
| Tork AFH | NA | NA | N | — |
| Tork AFH | NA | NA | N | — |
| Grainger AFH | NA | NA | N | 37 |
| Grainger AFH | NA | NA | N | 37 |
| Grainger AFH | NA | NA | N | 37 |
| Grainger AFH | NA | NA | N | 37 |
| Grainger AFH | NA | NA | N | 37 |
| Grainger AFH | NA | NA | N | 37 |
| Grainger AFH | NA | NA | N | 37 |
| Grainger AFH | NA | NA | N | 37 |
| Grainger AFH | NA | NA | N | 37 |
| Grainger AFH | NA | NA | N | 37 |
| Grainger AFH | NA | NA | N | 37 |
| Grainger AFH | NA | NA | N | 37 |
| Grainger AFH | NA | NA | N | 37 |

TABLE 1-continued

| | | | | |
|---|---|---|---|---|
| Grainger AFH | NA | NA | N | 37 |
| Mkt Bath | 426 | 4 | Y | 50 |
| Mkt Towel | — | 5.9 | Y | 55 |
| Mkt Towel | — | 10.2 | Y | 55 |
| Mkt Towel | — | 10.2 | Y | 55 |

Figure 8A:
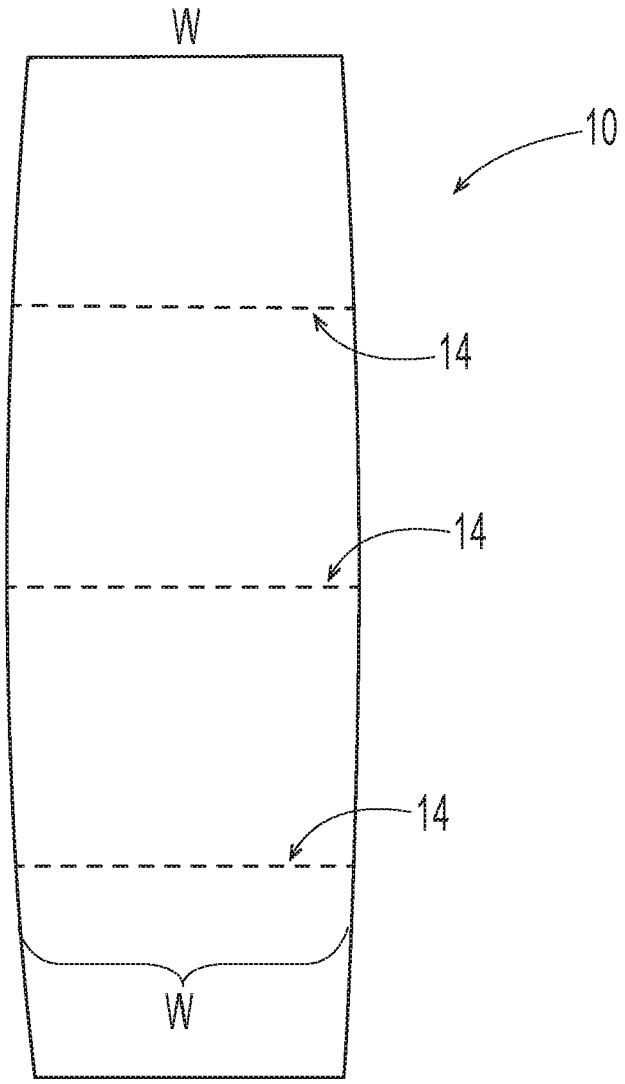
FIG. 8A is a front view of an example of a sanitary tissue product roll according to the present invention.

In one example, the sanitary tissue product rolls 10, for example toilet tissue product rolls, as shown in FIG. 8A, exhibit a roll width W of less than 6.0 inches and/or less than 5.0 inches and/or less than 4.5 inches and/or greater than 2.5 inches and/or greater than 3.0 inches and/or greater than 3.5 inches and/or from about 3.5 inches to about 4.5 inches. In one example, the sanitary tissue products, for example toilet tissue products, forming the sanitary tissue product rolls exhibit widths, for example CD widths, of less than 6.0 inches and/or less than 5.0 inches and/or less than 4.5 inches and/or greater than 2.5 inches and/or greater than 3.0 inches and/or greater than 3.5 inches and/or from about 3.5 inches to about 4.5 inches.

Figure 8B:
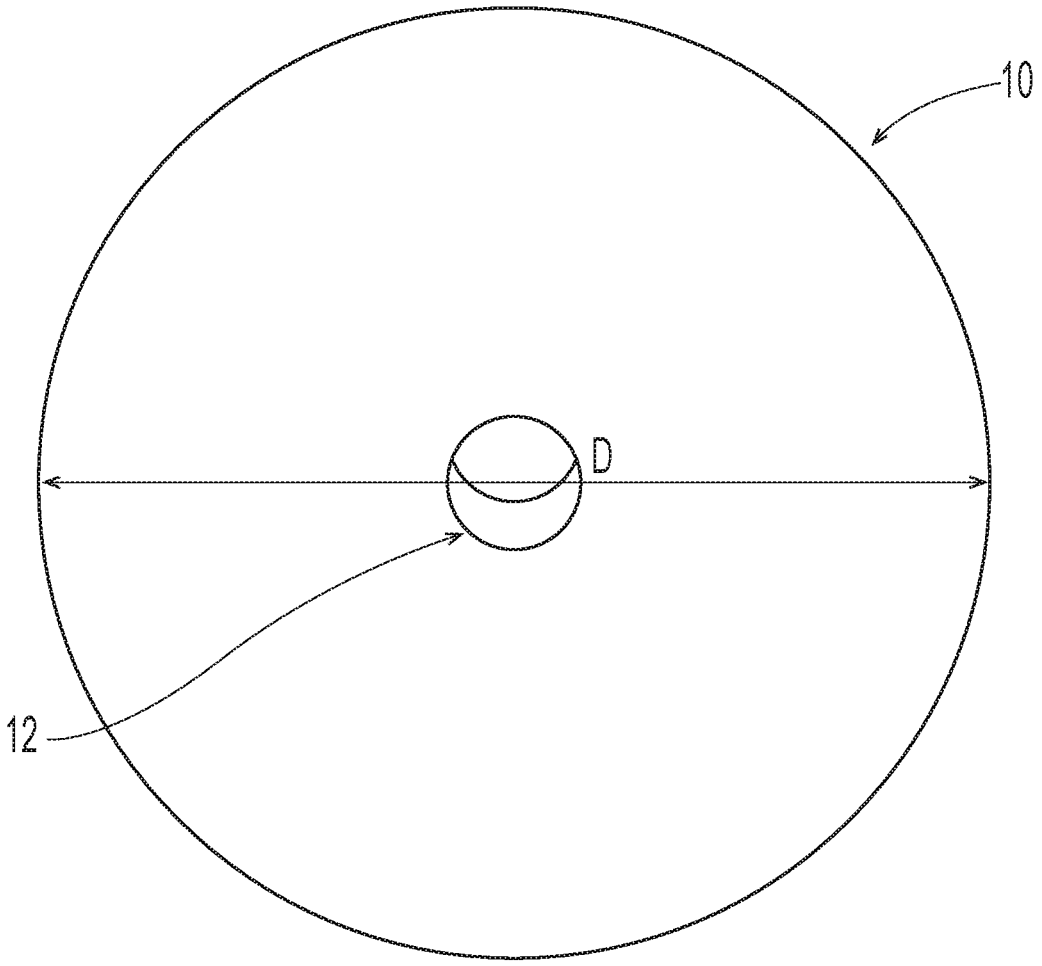
FIG. 8B is a side view of the sanitary tissue product roll of FIG. 8A.
Figure 8C:
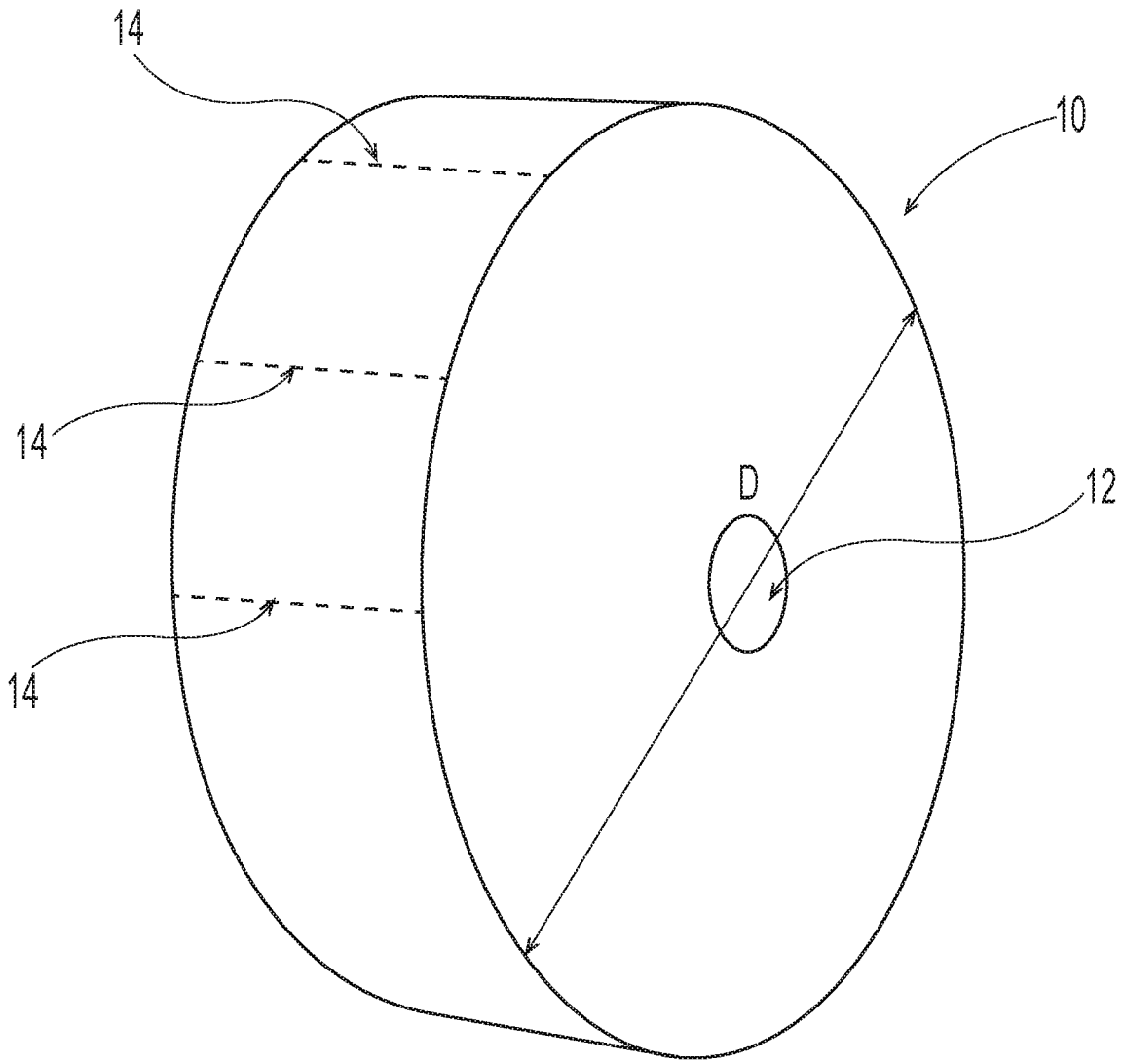
FIG. 8C is a perspective view of the sanitary tissue product roll of FIG. 8A.

In one example of the present invention as shown in FIGS. 8B and 8C, the sanitary tissue product 10 roll of the present invention comprises a web that has been convolutely wound about itself on a core 12 such that the sanitary tissue product roll 10 exhibits a Roll Diameter D of greater than 8.25 inches and/or at least 9.00 inches and/or at least 10.00 inches and/or at least 11.00 inches and/or at least 12.00 inches and/or at least 15.00 inches and/or greater than 8.25 inches to about 30.00 inches and/or greater than 8.25 inches to about 25.00 inches and/or at least 9.00 inches to about 20.00 inches as measured according to the Roll Diameter Test Method described herein, a Moment of Inertia of greater than 1.50 $g*m^2$ and/or greater than 1.60 $g*m^2$ and/or greater than 2.00 $g*m^2$ and/or greater than 2.50 $g*m^2$ and/or greater than 5.00 $g*m^2$ and/or greater than 6.50 $g*m^2$ and/or greater than 10.00 $g*m^2$ and/or greater than 1.50 $g*m^2$ to about 100.00 $g*m^2$ and/or greater than 2.00 $g*m^2$ to about 50.00 $g*m^2$ and/or 6.50 $g*m^2$ to about 50.00 $g*m^2$ as measured according to the Moment of Inertia Test Method described herein, a Roll Density of less than 0.250 $g/cm^3$ and/or less than 0.225 $g/cm^3$ and/or less than 0.200 $g/cm^3$ and/or less than 0.175 $g/cm^3$ and/or less than 0.150 $g/cm^3$ and/or 0.125 $g/cm^3$ and/or 0.100 $g/cm^3$ and/or 0.075 $g/cm^3$ and/or less than 0.250 $g/cm^3$ to about 0.010 $g/cm^3$ and/or less than 0.250 $g/cm^3$ to about 0.020 $g/cm^3$ and/or less than 0.225 $g/cm^3$ to about 0.020 $g/cm^3$ and/or less than 0.200 $g/cm^3$ to about 0.050 $g/cm^3$ and/or less than 0.200 $g/cm^3$ to about 0.075 $g/cm^3$ (for example toilet tissue product rolls) and/or less than 0.200 $g/cm^3$ to about 0.100 $g/cm^3$ (for example toilet tissue product rolls) and/or less than 0.100 $g/cm^3$ to about 0.010 $g/cm^3$ (for example paper towel product rolls) and/or less than 0.075 $g/cm^3$ to about 0.020 $g/cm^3$ (for example paper towel product rolls)and/or less than 0.075 $g/cm^3$ to about 0.040 $g/cm^3$ (for example paper towel product rolls)and/or less than 0.075 $g/cm^3$ to about 0.050 $g/cm^3$ (for example paper towel product rolls) and/or as measured according to the Roll Density Test Method described herein.

As shown in FIGS. 8A and 8C, the sanitary tissue product roll 10 and/or web comprises one or more perforations or areas or lines of weakness, for example a plurality of perforations 14.

The sanitary tissue product, for example toilet tissue product, may exhibit a sum of MD and CD dry tensile of less than 1000 g/in and/or less than 900 g/in and/or less than 800 g/in and/or less than 750 g/in and/or less than 700 g/in and/or less than 650 g/in and/or less than 600 g/in and/or less than 550 g/in and/or greater than 250 g/in and/or greater than 300 g/in and/or greater than 350 g/in and/or less than 1000 g/in to about 250 g/in and/or less than 900 g/in to about 300 g/in and/or less than 800 g/in to about 400 g/in.

The sanitary tissue product, for example paper towel product, may exhibit a sum of MD and CD dry tensile of greater than 1500 g/in and/or greater than 1750 g/in and/or greater than 2000 g/in and/or greater than 2100 g/in and/or greater than 2200 g/in and/or greater than 2300 g/in and/or greater than 2400 g/in and/or greater than 2500 g/in and/or less than 5000 g/in and/or less than 4000 g/in and/or less than 3500 g/in and/or greater than 1500 g/in to about 5000 g/in and/or greater than 1750 g/in to about 4000 g/in and/or greater than 1750 g/in to about 3500 g/in.

The sanitary tissue product rolls of the present disclosure may exhibit a Roll Compressibility of from about 0.5% to about 8.0% and/or from about 0.5% to about 6.0% and/or from about 0.7% to about 4.0% and/or from about 0.7% to about 3.0% and/or from about 1.0% to about 2.5% and/or from about 1.0% to about 2.0% as measured according to the Percent Compressibility Test Method described herein. The rolled sanitary tissue products of the present disclosure may exhibit a roll compressibility of less than 8.0% and/or less than 6.0% and/or less than 4.0% and/or less 3.0% and/or less than 2.5% and/or less than 2.0% and/or greater than 0.0% and/or greater than 0.2% and/or greater than 0.5% and/or greater than 0.7% and/or greater than 1.0% as measured according to the Percent Compressibility Test Method described herein. Further, in one example, the sanitary tissue product rolls of the present invention are wound to diameters of greater than 6.5 inches and/or greater than 6.9 inches and/or greater than 7.9 inches and/or greater than 8.25 inches and/or at least 9.00 inches and/or at least 10.00 inches and/or at least 11.00 inches and/or at least 12.00 inches and/or at least 15.00 inches and/or greater than 8.25 inches to about 30.00 inches and/or greater than 8.25 inches to about 25.00 inches and/or at least 9.00 inches to about 20.00 inches as measured according to the Roll Diameter Test Method described herein such that the sanitary tissue product rolls exhibit a higher Roll Compressibility as the sanitary tissue product rolls' diameters decrease such as during use by a consumer.

The sanitary tissue products (e.g., toilet tissue products) of the present disclosure may exhibit a geometric mean peak elongation of greater than 10%, and/or greater than 15%, and/or greater than 20%, and/or greater than 25%, as measured according to the respective Dry Tensile Strength Test Method described herein.

The sanitary tissue products (e.g., toilet tissue products) of the present disclosure may exhibit a geometric mean dry tensile strength of greater than about 200 g/in, and/or greater than about 250 g/in, and/or greater than about 300 g/in, and/or greater than about 350 g/in, and/or greater than about 400 g/in, and/or greater than about 500 g/in, and/or greater than about 750 g/in, as measured according to the respective Dry Tensile Strength Test Method described herein.

The sanitary tissue products (e.g., toilet tissue products) of the present disclosure may exhibit a geometric mean modulus of less than about 20,000 g/cm, and/or less than about 15,000 g/cm, and/or less than about 10,000 g/cm, and/or less than about 5,000 g/cm, and/or less than about 3,000 g/cm, and/or less than about 1,500 g/cm, and/or less than about 1,200 g/cm, and/or between about 1,200 g/cm and about 0 g/cm, and/or between about 1,200 g/cm and about 700 g/cm, as measured according to the respective Dry Tensile Strength Test Method described herein.

The sanitary tissue products (e.g., toilet tissue products) of the present disclosure may exhibit a CD elongation of greater than about 8%, and/or greater than about 10%, and/or greater than about 12%, and/or greater than about 15%, and/or greater than about 20%, as measured according to the respective Dry Tensile Strength Test Method described herein. Further, the sanitary tissue products (e.g., toilet tissue products) of the present disclosure may exhibit a CD elongation of from about 8% to about 20%, or from about 10% to about 20%, or from about 10% to about 15%, as measured according to the respective Dry Tensile Strength Test Method described herein.

The sanitary tissue products (e.g., toilet tissue products) of the present disclosure may exhibit a dry burst of less than about 660 g, and/or from about 100 g to about 600 g, as measured according to the Dry Burst Test Method described herein. In another example, the sanitary tissue products (e.g., toilet tissue products) of the present disclosure may exhibit a dry burst of greater than about 100 g, and/or from about 100 g to about 1000 g, and/or from about 100 g to about 600 g, as measured according to the Dry Burst Test Method described herein.

The paper towel products of the present disclosure may exhibit a wet burst strength of greater than about 270 grams, in another form from about 290 g, about 300 g, or about 315 g to about 360 g, about 380 g, or about 400 g as measured according to the Wet Burst Test Method described herein.

The toilet tissue products of the present disclosure may exhibit an initial total wet tensile strength of less than about 78 g/cm (200 g/in) and/or less than about 59 g/cm (150 g/in) and/or less than about 39 g/cm (100 g/in) and/or less than about 29 g/cm (75 g/in) and/or less than about 23 g/cm (60 g/in) and/or less than about 20 g/cm (50 g/in) and/or about less than about 16 g/cm (40 g/cm) as measured according to the Wet Tensile Test Method described herein. In addition, the paper towel products of the present disclosure may exhibit an initial total wet tensile strength ("ITWT") of greater than about 118 g/cm (300 g/in) and/or greater than about 157 g/cm (400 g/in) and/or greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 118 g/cm (300 g/in) to about 1968 g/cm (5000 g/in) and/or from about 157 g/cm (400 g/in) to about 1181 g/cm (3000 g/in) and/or from about 196 g/cm (500 g/in) to about 984 g/cm (2500 g/in) and/or from about 196 g/cm (500 g/in) to about 787 g/cm (2000 g/in) and/or from about 196 g/cm (500 g/in) to about 591 g/cm (1500 g/in) as measured according to the Wet Tensile Test Method described herein.

Furthermore, the paper towel products of present disclosure may exhibit an initial total wet tensile strength of less than about 800 g/25.4 mm and/or less than about 600 g/25.4 mm and/or less than about 450 g/25.4 mm and/or less than about 300 g/25.4 mm and/or less than about 225 g/25.4 mm as measured according to the Wet Tensile Test Method described herein.

The toilet tissue products of the present invention may exhibit a decayed initial total wet tensile strength at 30 minutes of less than about 39 g/cm (100 g/in) and/or less than about 30 g/cm (75 g/in) and/or less than about 20 g/cm (50 g/in) and/or less than about 16 g/cm (40 g/in) and/or less than about 12 g/cm (30 g/in) and/or less than about 8 g/cm (20 g/in) and/or less than about 4 g/cm (10 g/in) as measured according to the Wet Tensile Test Method described herein.

The sanitary tissue products and/or webs of the present invention may exhibit a caliper of from about 5 mils to about 50 mils and/or from about 7 mils to about 45 mils and/or from about 10 mils to about 40 mils and/or from about 12 mils to about 30 mils and/or from about 15 mils to about 28 mils as measured according to the Caliper Test Method described herein.

The web may comprise a structured web, for example a web comprising at least one 3D patterned fibrous structure ply, for example a through-air-dried web, such as a creped through-air-dried fibrous structure ply and/or an uncreped through-air-dried fibrous structure ply.

The web may comprise a creped fibrous structure ply, for example a fabric creped fibrous structure ply and/or a belt creped fibrous structure ply and/or a conventional wet pressed fibrous structure ply.

The web may comprise through-air-dried (creped or uncreped) fibrous structures, belt creped fibrous structures, fabric creped fibrous structures, NTT fibrous structures, ATMOS fibrous structures, conventional wet pressed fibrous structures, and mixtures thereof.

The web may comprise an embossed fibrous structure ply.

The web may be a wet-laid web and/or an air-laid web.

The webs and/or sanitary tissue products of the present invention may comprise a surface softening agent or be void of a surface softening agent. In one example, the sanitary tissue product is a non-lotioned sanitary tissue product, such as a sanitary tissue product comprising a non-lotioned fibrous structure ply, for example a non-lotioned through-air-dried fibrous structure ply, for example a non-lotioned creped through-air-dried fibrous structure ply and/or a non-lotioned uncreped through-air-dried fibrous structure ply. In yet another example, the sanitary tissue product may comprise a non-lotioned fabric creped fibrous structure ply and/or a non-lotioned belt creped fibrous structure ply.

The webs and/or sanitary tissue products of the present invention may comprise trichome fibers and/or may be void of trichome fibers.

The sanitary tissue products or rolls of the present invention may comprise a core exhibiting a Core Kinetic Coefficient of Friction of greater than 0.10 and less than 0.50 and/or greater than 0.15 to less than 0.45 and/or greater than 0.18 to less than 0.40 and/or greater than 0.20 to less than 0.40 and/or greater than 0.23 to less than 0.35 as measured according to the Core Kinetic Coefficient of Friction Measurement Test Method described herein. In one example, the sanitary tissue products or rolls of the present invention may comprise a core exhibiting a Core Kinetic Coefficient of Friction of from about 0.18 to about 0.30 as measured according to the Core Kinetic Coefficient of Friction Measurement Test Method described herein.

While not wishing to be bound by theory, the sanitary tissue products of the present invention may acquire too much rotational momentum or energy when a consumer starts the inventive roll rotating as part of dispensing a desired amount of sanitary tissue. The inventors have unexpected discovered any acquired rotational momentum or energy associated with putting the inventive roll into rotation can be offset by a resistance to rotation derived from the core material friction exerted between the spindle and the core and/or core/roll assembly. Hence, the Core Kinetic Coefficient of Friction value as measured according to the Core Kinetic Coefficient of Friction Measurement Test Method described herein provides for the inventive level of friction which may be exhibited by sanitary tissue products, rolls, or cores of the present invention.

Non-limiting Examples of Making Sanitary Tissue Product Rolls

The sanitary tissue products and webs of the present invention may be made by any suitable papermaking process so long as the sanitary tissue products are ultimately convolutely wound into sanitary tissue product rolls of the present invention. For example, the webs may be made by wet-laid and/or air-laid and/or co-form processes. Non-limiting examples of suitable wet-laid processes include through-air-drying (creped and uncreped) process, belt creped process, fabric creped process, NTT process, ATMOS process, conventional wet pressed process, and mixtures thereof.

The papermaking process may be a sanitary tissue product making process that uses a cylindrical dryer such as a Yankee (a Yankee-process) or it may be a Yankeeless process (for example an uncreped through-air-dried or UCTAD) as is used to make substantially uniform density. Alternatively, the webs and/or sanitary tissue products may be made by an air-laid process and/or meltblown and/or spunbond processes and/or co-forming process and any combinations thereof so long as the sanitary tissue product rolls of the present invention are made from the webs (fibrous structures) and/or sanitary tissue products.

In one example, the sanitary tissue product rolls of the present invention, for example a single-ply or multi-ply sanitary tissue product rolls, in this case a multi-ply sanitary tissue product roll may be made by combining and/or marrying, such as by plybonding with an adhesive (chemically), such as a plybond glue, for example a polyvinylalcohol-based glue, or knurling (mechanically) via knurling wheels, two or more webs (fibrous structures) together to form a multi-ply sanitary tissue product and then ultimately winding the multi-ply sanitary tissue product into a multi-ply sanitary tissue product roll as follows. Two or more parent rolls of a web (fibrous structure) of the present invention are converted into a sanitary tissue product roll by loading each roll of web (fibrous structure) into an unwind stand. In one example, the line speed may be from about 200 ft/min to about 800 ft/min and/or from about 200 ft/min to about 600 ft/min and/or from about 300 ft/min to about 500 ft/min and/or about 400 ft/min. One parent roll of the web (fibrous structure) is unwound and transported to an emboss nip (patterned steel roll and a rubber roll) where the web (fibrous structure) is strained to form an emboss pattern in the web (fibrous structure). The embossed web is then combined and married with the web (fibrous structure) from the other parent roll to make a multi-ply (2-ply) sanitary tissue product. The multi-ply sanitary tissue product is then transported over a slot extruder through which a surface chemistry, for example a surface softening agent, may be applied. The multi-ply sanitary tissue product is then transported to a winder, for example a surface winder or a drum rewinder or center winder, in one example a surface winder, passing through a perforating station at a speed of from about 75 ft/min to about 400 ft/min and/or from about 100 ft/min to about 300 ft/min and/or from about 150 ft/min to about 225 ft/min, on its way to the winder to impart a plurality of perforations into the multi-ply sanitary tissue product at about every 4 inches resulting in about 850 sheets in the multi-ply sanitary tissue product. After the perforating station, the multi-ply sanitary tissue product is wound onto a core having an outer diameter of about 1.65 inches such that a log from which the finished sanitary tissue product rolls as described below are made is formed. In one example, the surface winder runs at a speed the same as the line speed above or faster, for example from about 200 ft/min to about 1000 ft/min and/or from about 300 ft/min to about 800 ft/min and/or from about 300 ft/min to about 700 ft/min and/or about 600 ft/min In one example, the log runs through a tail sealing operation to seal the tail of the multi-ply sanitary tissue product. The log of multi-ply sanitary tissue product is then transported to a log saw where the log is cut into finished multi-ply sanitary tissue product rolls.

In another example, the sanitary tissue product rolls of the present invention, for example a single-ply or multi-ply sanitary tissue product rolls, in this case a multi-ply sanitary tissue product roll may be made by combining and/or marrying, such as by plybonding with an adhesive (chemically), such as a plybond glue, for example a polyvinylalcohol-based glue, or knurling (mechanically) via knurling wheels, two or more webs (fibrous structures) together to form a multi-ply sanitary tissue product and then ultimately winding the multi-ply sanitary tissue product into a multi-ply sanitary tissue product roll as follows. A pre-combined/pre-married and optionally embossed and/or optionally surface softened multi-ply sanitary tissue product parent roll may be converted into a finished sanitary tissue product roll by loading the pre-combined/pre-married multi-ply sanitary tissue product parent roll into an unwind stand. In one example, the line speed may be from about 200 ft/min to about 800 ft/min and/or from about 200 ft/min to about 600 ft/min and/or from about 300 ft/min to about 500 ft/min and/or about 400 ft/min. The pre-combined/pre-married multi-ply sanitary tissue product parent roll is unwound and transported to a winder, for example a surface winder or a drum rewinder or center winder, in one example a surface winder, passing through a perforating station at a speed of from about 75 ft/min to about 400 ft/min and/or from about 100 ft/min to about 300 ft/min and/or from about 150 ft/min to about 225 ft/min, on its way to the winder to impart a plurality of perforations into the pre-combined/pre-married multi-ply sanitary tissue product at about every 4 inches resulting in about 850 sheets in the pre-combined/pre-married multi-ply sanitary tissue product. After the perforating station, the pre-combined/pre-married multi-ply sanitary tissue product is wound onto a core having an outer diameter of about 1.65 inches such that a log from which the finished sanitary tissue product rolls as described below are made is formed. In one example, the surface winder runs at a speed the same as the line speed above or faster, for example from about 200 ft/min to about 1000 ft/min and/or from about 300 ft/min to about 800 ft/min and/or from about 300 ft/min to about 700 ft/min and/or about 600 ft/min. In one example, the log runs through a tail sealing operation to seal the tail of the pre-combined/pre-married multi-ply sanitary tissue product. The log of pre-combined/pre-married multi-ply sanitary tissue product is then transported to a log saw where the log is cut into finished multi-ply sanitary tissue product rolls.

The sanitary tissue product rolls may be packaged in film wrap and/or film bags, such as resealable film bags for sale.

Figure 9A:
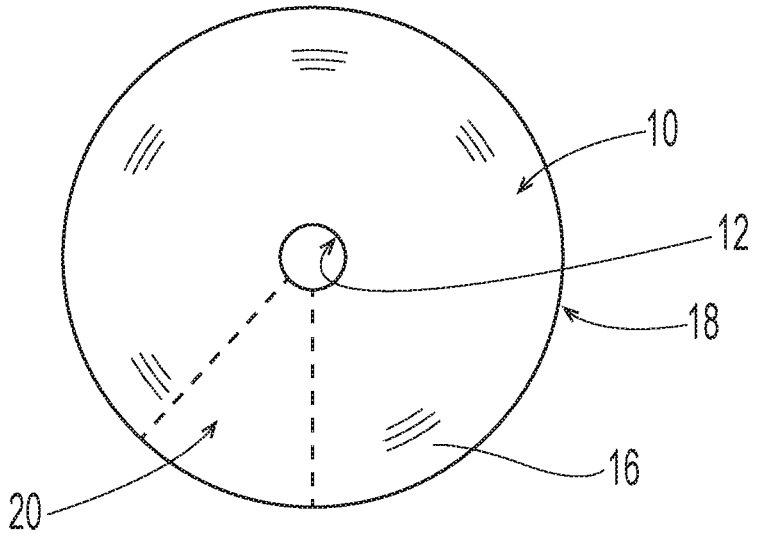
FIG. 9A is a schematic representation of a shrink film wrap package of a sanitary tissue product roll according to the present invention.
Figure 9B:
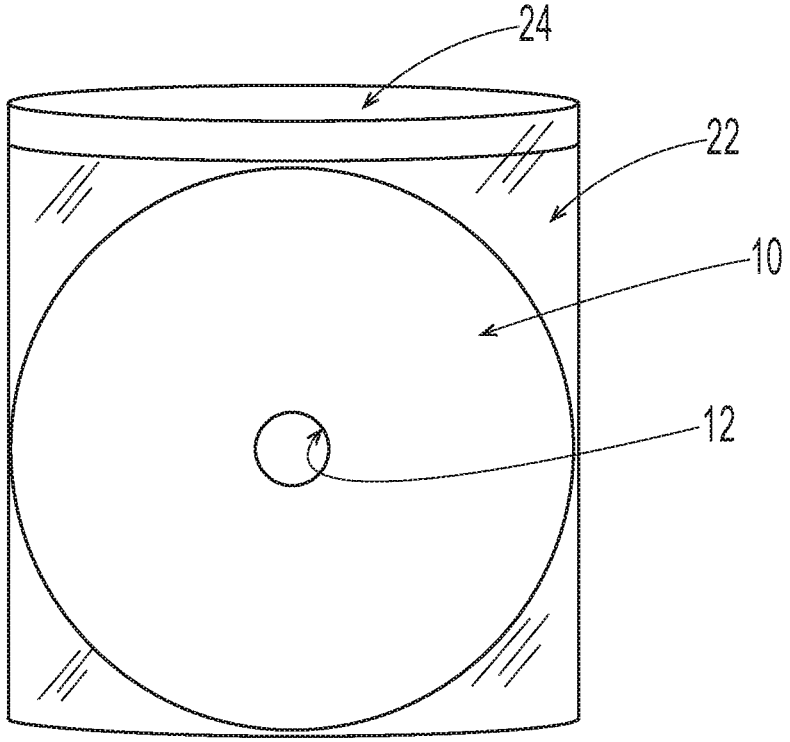
FIG. 9B is a schematic representation of a film bag package of a sanitary tissue product roll according to the present invention.

The film wrap package may be shrink wrap film package 16 as shown in FIG. 9A. The shrink wrap film package 16 may result in compressing the edges 18 of the sanitary tissue product roll 10 contained therein such that the sanitary tissue product roll 10 will exhibit rounded/curved edges. As shown in FIG. 9A, the shrink wrap film package 16 may have a perforated tab 20 that extends from about the core to at least an edge 18 of the sanitary tissue product roll 10 by which a user can open the shrink wrap film package 16 to gain access to the sanitary tissue product roll 10 upon pulling the perforated tab 20. Alternatively, the sanitary tissue product roll 10 may be packaged in a film bag 22, for example a film bag 22 comprising a resealable opening 24, as shown in FIG. 9B. In another example, the sanitary tissue product rolls, for example one or more and/or two or more sanitary tissue product rolls, may be packaged in boxes, for example corrugated boxes/cases and/or knock-down-flats (KDFs), as naked sanitary tissue product rolls.

Non-Limiting Examples of Methods for Making Sanitary Tissue Product Rolls

Example 1—Toilet Tissue

The following Example illustrates a non-limiting example for a preparation of a sanitary tissue product roll comprising a web comprising a fibrous structure ply according to the present invention made on a pilot-scale Fourdrinier fibrous structure making (papermaking) machine.

An aqueous slurry of eucalyptus (Suzano, formerly Fibria, Brazilian bleached hardwood kraft pulp) pulp fibers is prepared at about 3% fiber by weight using a conventional repulper, then transferred to the hardwood fiber stock chest. The eucalyptus fiber slurry of the hardwood stock chest is pumped through a stock pipe to a hardwood fan pump where the slurry consistency is reduced from about 3% by fiber weight to about 0.15% by fiber weight. The 0.15% eucalyptus slurry is then pumped and equally distributed in the top and bottom chambers of a multi-layered, three-chambered headbox of a Fourdrinier wet-laid papermaking machine.

Additionally, an aqueous slurry of NSK (Northern Softwood Kraft) pulp fibers is prepared at about 3% fiber by weight using a conventional repulper, then transferred to the softwood fiber stock chest. The NSK fiber slurry of the softwood stock chest is pumped through a stock pipe to be refined to a Canadian Standard Freeness (CSF) of about 630. The refined NSK fiber slurry is then directed to the NSK fan pump where the NSK slurry consistency is reduced from about 3% by fiber weight to about 0.15% by fiber weight. The 0.15% eucalyptus slurry is then directed and distributed to the center chamber of a multi-layered, three-chambered headbox of a Fourdrinier wet-laid papermaking machine.

The wet-laid papermaking machine has a layered headbox having a top chamber, a center chamber, and a bottom chamber where the chambers feed directly onto the forming wire (Fourdrinier wire). The eucalyptus fiber slurry of 0.15% consistency is directed to the top headbox chamber and bottom headbox chamber. The NSK fiber slurry is directed to the center headbox chamber. All three fiber layers are delivered simultaneously in superposed relation onto the Fourdrinier wire to form thereon a three-layer embryonic fibrous structure (web), of which about 38% of the top side is made up of the eucalyptus fibers, about 38% is made of the eucalyptus fibers on the bottom side and about 24% is made up of the NSK fibers in the center. Dewatering occurs through the Fourdrinier wire and is assisted by a deflector and wire table vacuum boxes. The Fourdrinier wire is an 84M (84 by 76 5A, Albany International). The speed of the Fourdrinier wire is about 750 feet per minute (fpm).

The embryonic wet fibrous structure is transferred from the Fourdrinier wire, at a fiber consistency of about 15% at the point of transfer, to a 3D patterned through-air-drying belt. The speed of the 3D patterned through-air-drying belt is the same as the speed of the Fourdrinier wire. The 3D patterned through-air-drying belt is designed to yield a fibrous structure comprising a pattern of high density knuckle regions dispersed throughout a multi-elevational continuous pillow region. The multi-elevational continuous pillow region comprises an intermediate density pillow region (density between the high density knuckles and the low density other pillow region) and a low density pillow region formed by the deflection conduits created by the semi-continuous knuckle layer substantially oriented in the machine direction. The supporting fabric of the 3D patterned through-air-drying belt is a 98×52 filament, dual layer fine mesh. The thickness of the first layer resin cast of the belt is about 6 mils above the supporting fabric and the thickness of the second layer resin cast of the belt is about 13 mils above the supporting fabric.

Further de-watering of the fibrous structure is accomplished by vacuum assisted drainage until the fibrous structure has a fiber consistency of about 20% to 30%.

While remaining in contact with the 3D patterned through-air-drying belt, the fibrous structure is pre-dried by air blow-through pre-dryers to a fiber consistency of about 53% by weight.

After the pre-dryers, the semi-dry fibrous structure is transferred to a Yankee dryer and adhered to the surface of the Yankee dryer with a sprayed creping adhesive. The creping adhesive is an aqueous dispersion with the actives consisting of about 80% polyvinyl alcohol (PVA 88-50), about 20% CREPETROL® 457T20. CREPETROL® 457T20 is commercially available from Hercules Incorporated of Wilmington, Del. The creping adhesive is delivered to the Yankee surface at a rate of about 0.15% adhesive solids based on the dry weight of the fibrous structure. The fiber consistency is increased to about 97% before the fibrous structure is dry-creped from the Yankee with a doctor blade.

The doctor blade has a bevel angle of about 25° and is positioned with respect to the Yankee dryer to provide an impact angle of about 81°. The Yankee dryer is operated at a temperature of about 275° F. and a speed of about 800 fpm. The fibrous structure is wound in a roll (parent roll) using a surface driven reel drum having a surface speed of about 757 fpm.

Example 1A—Toilet Tissue Roll

Two parent rolls of the web (fibrous structure) of Example 1 are converted into a sanitary tissue product roll by loading each roll of web (fibrous structure) into an unwind stand. The line speed is 400 ft/min. One parent roll of the web (fibrous structure) is unwound and transported to an emboss stand where the web (fibrous structure) is strained to form an emboss pattern in the web (fibrous structure) and then combined with the web (fibrous structure) from the other parent roll to make a multi-ply (2-ply) sanitary tissue product. The multi-ply sanitary tissue product is then transported over a slot extruder through which a surface chemistry may be applied. The multi-ply sanitary tissue product is then transported to a winder passing through a perforating station to impart a plurality of perforations into the multi-ply sanitary tissue product at about every 4 inches resulting in about 850 sheets in the multi-ply sanitary tissue product before it is wound onto a core having an outer diameter of about 1.65 inches such that a log from which the finished sanitary tissue product rolls as described below are made is formed. The log of multi-ply sanitary tissue product is then transported to a log saw where the log is cut into finished multi-ply sanitary tissue product rolls having a total sanitary tissue product length of about 3400 inches, a roll and sheet width of about 3.94 inches, a sheet caliper of about 19.0 mils as measured according to the Caliper Test Method described herein, and a Basis Weight of about 48 gsm as measured according to the Basis Weight Test Method for Toilet Tissue Samples described herein. At least one of the finished multi-ply sanitary tissue product rolls exhibits a Roll Diameter of about 8.52 inches as measured according to the Roll Diameter Test Method described herein, a Moment of Inertia of about 2.60 $g*m^2$ as measured according to the Moment of Inertia Test Method described herein, and a Roll Density of about 0.121 $g/cm^3$ as measured according to the Roll Density Test Method described herein.

Example 1B—Toilet Tissue Roll

Two parent rolls of the web (fibrous structure) of Example 1 are converted into a sanitary tissue product roll by loading each roll of web (fibrous structure) into an unwind stand. The line speed is 400 ft/min. One parent roll of the web (fibrous structure) is unwound and transported to an emboss stand where the web (fibrous structure) is strained to form the emboss pattern in the web (fibrous structure) and then combined with the web (fibrous structure) from the other parent roll to make a multi-ply (2-ply) sanitary tissue product. The multi-ply sanitary tissue product is then transported over a slot extruder through which a surface chemistry may be applied. The multi-ply sanitary tissue product is then transported to a winder passing through a perforating station to impart a plurality of perforations into the multi-ply sanitary tissue product at about every 4 inches resulting in about 850 sheets in the multi-ply sanitary tissue product before it is wound onto a core having an outer diameter of about 1.65 inches such that a log from which the finished sanitary tissue product rolls as described below are made is formed. The log of multi-ply sanitary tissue product is then transported to a log saw where the log is cut into finished multi-ply sanitary tissue product rolls having a total sanitary tissue product length of about 3400 inches, a roll and sheet width of about 3.94 inches, a sheet caliper of about 19.0 mils as measured according to the Caliper Test Method described herein, and a Basis Weight of about 48 gsm as measured according to the Basis Weight Test Method for Toilet Tissue Samples described herein. At least one of the finished multi-ply sanitary tissue product roll exhibits a Roll Diameter of about 8.75 inches as measured according to the Roll Diameter Test Method described herein, a Moment of Inertia of about 2.69 $g*m^2$ as measured according to the Moment of Inertia Test Method described herein, and a Roll Density of about 0.113 $g/cm^3$ as measured according to the Roll Density Test Method described herein.

Example 1C—Toilet Tissue Roll

Two parent rolls of the web (fibrous structure) of Example 1 are converted into a sanitary tissue product roll by loading each roll of web (fibrous structure) into an unwind stand. The line speed is 400 ft/min. One parent roll of the web (fibrous structure) is unwound and transported to an emboss stand where the web (fibrous structure) is strained to form the emboss pattern in the web (fibrous structure) and then combined with the web (fibrous structure) from the other parent roll to make a multi-ply (2-ply) sanitary tissue product. The multi-ply sanitary tissue product is then transported over a slot extruder through which a surface chemistry may be applied. The multi-ply sanitary tissue product is then transported to a winder passing through a perforating station to impart a plurality of perforations into the multi-ply sanitary tissue product at about every 4 inches resulting in about 1700 sheets in the multi-ply sanitary tissue product before it is wound onto a core having an outer diameter of about 1.65 inches such that a log from which the finished sanitary tissue product rolls as described below are made is formed. The log of multi-ply sanitary tissue product is then transported to a log saw where the log is cut into finished multi-ply sanitary tissue product rolls having a total sanitary tissue product length of about 6800 inches, a roll and sheet width of about 3.94 inches, a sheet caliper of about 19.0 mils as measured according to the Caliper Test Method described herein, and a Basis Weight of about 48 gsm as measured according to the Basis Weight Test Method for Toilet Tissue Samples described herein. At least one of the finished multi-ply sanitary tissue product roll exhibits a Roll Diameter of about 11.97 inches as measured according to the Roll Diameter Test Method described herein, a Moment of Inertia of about 10.26 $g*m^2$ as measured according to the Moment of Inertia Test Method described herein, and a Roll Density of about 0.122 $g/cm^3$ as measured according to the Roll Density Test Method described herein.

Example 1D—Toilet Tissue Roll

Two parent rolls of the web (fibrous structure) of Example 1 are converted into a sanitary tissue product roll by loading each roll of web (fibrous structure) into an unwind stand. The line speed is 400 ft/min. One parent roll of the web (fibrous structure) is unwound and transported to an emboss stand where the web (fibrous structure) is strained to form the emboss pattern in the web (fibrous structure) and then combined with the web (fibrous structure) from the other parent roll to make a multi-ply (2-ply) sanitary tissue product. The multi-ply sanitary tissue product is then transported over a slot extruder through which a surface chemistry may be applied. The multi-ply sanitary tissue product is then transported to a winder passing through a perforating station to impart a plurality of perforations into the multi-ply sanitary tissue product at about every 4 inches resulting in about 1700 sheets in the multi-ply sanitary tissue product before it is wound onto a core having an outer diameter of about 1.65 inches such that a log from which the finished sanitary tissue product rolls as described below are made is formed. The log of multi-ply sanitary tissue product is then transported to a log saw where the log is cut into finished multi-ply sanitary tissue product rolls having a total sanitary tissue product length of about 6800 inches, a roll and sheet width of about 3.94 inches, a sheet caliper of about 19.0 mils as measured according to the Caliper Test Method described herein, and a Basis Weight of about 48 gsm as measured according to the Basis Weight Test Method for Toilet Tissue Samples described herein. At least one of the finished multi-ply sanitary tissue product roll exhibits a Roll Diameter of about 12.33 inches as measured according to the Roll Diameter Test Method described herein, a Moment of Inertia of about 10.89 $g*m^2$ as measured according to the Moment of Inertia Test Method described herein, and a Roll Density of about 0.115 g/cm$^3$ as measured according to the Roll Density Test Method described herein.

Example 1E—Toilet Tissue Roll

Two parent rolls of the web (fibrous structure) of Example 1 are converted into a sanitary tissue product roll by loading each roll of web (fibrous structure) into an unwind stand. The line speed is 400 ft/min. One parent roll of the web (fibrous structure) is unwound and transported to an emboss stand where the web (fibrous structure) is strained to form the emboss pattern in the web (fibrous structure) and then combined with the web (fibrous structure) from the other parent roll to make a multi-ply (2-ply) sanitary tissue product. The multi-ply sanitary tissue product is then transported over a slot extruder through which a surface chemistry may be applied. The multi-ply sanitary tissue product is then transported to a winder passing through a perforating station to impart a plurality of perforations into the multi-ply sanitary tissue product at about every 4 inches resulting in about 2550 sheets in the multi-ply sanitary tissue product before it is wound onto a core having an outer diameter of about 1.65 inches such that a log from which the finished sanitary tissue product rolls as described below are made is formed. The log of multi-ply sanitary tissue product is then transported to a log saw where the log is cut into finished multi-ply sanitary tissue product rolls having a total sanitary tissue product length of about 10,200 inches, a roll and sheet width of about 3.94 inches, a sheet caliper of 19.0 mils as measured according to the Caliper Test Method described herein, and a Basis Weight of about 48 gsm as measured according to the Basis Weight Test Method for Toilet Tissue Samples described herein. At least one of the finished multi-ply sanitary tissue product roll exhibits a Roll Diameter of about 15.29 inches as measured according to the Roll Diameter Test Method described herein, a Moment of Inertia of about 34.84 g*m$^2$ as measured according to the Moment of Inertia Test Method described herein, and a Roll Density of about 0.156 g/cm$^3$ as measured according to the Roll Density Test Method described herein.

Example 1F—Toilet Tissue Roll

Two parent rolls of the web (fibrous structure) of Example 1 are converted into a sanitary tissue product roll by loading each roll of web (fibrous structure) into an unwind stand. The line speed is 400 ft/min. One parent roll of the web (fibrous structure) is unwound and transported to an emboss stand where the web (fibrous structure) is strained to form the emboss pattern in the web (fibrous structure) and then combined with the web (fibrous structure) from the other parent roll to make a multi-ply (2-ply) sanitary tissue product. The multi-ply sanitary tissue product is then transported over a slot extruder through which a surface chemistry may be applied. The multi-ply sanitary tissue product is then transported to a winder passing through a perforating station to impart a plurality of perforations into the multi-ply sanitary tissue product at about every 4 inches resulting in about 2550 sheets in the multi-ply sanitary tissue product before it is wound onto a core having an outer diameter of about 1.65 inches such that a log from which the finished sanitary tissue product rolls as described below are made is formed. The log of multi-ply sanitary tissue product is then transported to a log saw where the log is cut into finished multi-ply sanitary tissue product rolls having and a total sanitary tissue product length of about 10,200 inches, a roll and sheet width of about 3.94 inches, a sheet caliper of 19.0 mils as measured according to the Caliper Test Method described herein, and a Basis Weight of about 48 gsm as measured according to the Basis Weight Test Method for Toilet Tissue Samples described herein. At least one of the finished multi-ply sanitary tissue product roll exhibits a Roll Diameter of about 17.17 inches as measured according to the Roll Diameter Test Method described herein, a Moment of Inertia of about 53.45 g*m$^2$ as measured according to the Moment of Inertia Test Method described herein, and a Roll Density of about 0.151 g/cm$^3$ as measured according to the Roll Density Test Method described herein.

Example 1G—Toilet Tissue Roll

Two parent rolls of the web (fibrous structure) of Example 1 are converted into a sanitary tissue product roll by loading each roll of web (fibrous structure) into an unwind stand. The line speed is 400 ft/min. One parent roll of the web (fibrous structure) is unwound and transported to an emboss stand where the web (fibrous structure) is strained to form the emboss pattern in the web (fibrous structure) and then combined with the web (fibrous structure) from the other parent roll to make a multi-ply (2-ply) sanitary tissue product. The multi-ply sanitary tissue product is then transported over a slot extruder through which a surface chemistry may be applied. The multi-ply sanitary tissue product is then transported to a winder passing through a perforating station to impart a plurality of perforations into the multi-ply sanitary tissue product at about every 4 inches resulting in about 850 sheets in the multi-ply sanitary tissue product before it is wound onto a core having an outer diameter of about 1.65 inches such that a log from which the finished sanitary tissue product rolls as described below are made is formed. The log of multi-ply sanitary tissue product is then transported to a log saw where the log is cut into finished multi-ply sanitary tissue product rolls having a total sanitary tissue product length of about 3400 inches, a roll and sheet width of about 3.94 inches, a sheet caliper of about 19.0 mils as measured according to the Caliper Test Method described herein, and a Basis Weight of about 48 gsm as measured according to the Basis Weight Test Method for Toilet Tissue Samples described herein. At least one of the finished multi-ply sanitary tissue product roll exhibits a Roll Diameter of about 8.97 inches as measured according to the Roll Diameter Test Method described herein, a Moment of Inertia of about 2.92 g*m$^2$ as measured according to the Moment of Inertia Test Method described herein, and a Roll Density of about 0.110 g/cm$^3$ as measured according to the Roll Density Test Method described herein.

Example 1H—Toilet Tissue Roll

Two parent rolls of the web (fibrous structure) of Example 1 are converted into a sanitary tissue product roll by loading each roll of web (fibrous structure) into an unwind stand. The line speed is 400 ft/min. One parent roll of the web (fibrous structure) is unwound and transported to an emboss stand where the web (fibrous structure) is strained to form the emboss pattern in the web (fibrous structure) and then combined with the web (fibrous structure) from the other parent roll to make a multi-ply (2-ply) sanitary tissue product. The multi-ply sanitary tissue product is then transported over a slot extruder through which a surface chemistry may be applied. The multi-ply sanitary tissue product is then transported to a winder passing through a perforating station to impart a plurality of perforations into the multi-ply sanitary tissue product at about every 4 inches resulting in about 850 sheets in the multi-ply sanitary tissue product before it is wound onto a core having an outer diameter of about 1.65 inches such that a log from which the finished sanitary tissue product rolls as described below are made is formed. The log of multi-ply sanitary tissue product is then transported to a log saw where the log is cut into finished multi-ply sanitary tissue product rolls having a total sanitary tissue product length of about 3400 inches, a roll and sheet width of about 3.94 inches, a sheet caliper of about 19.0 mils as measured according to the Caliper Test Method described herein, and a Basis Weight of about 48 gsm as measured according to the Basis Weight Test Method for Toilet Tissue Samples described herein. At least one of the finished multi-ply sanitary tissue product roll exhibits a Roll Diameter of about 8.95 inches as measured according to the Roll Diameter Test Method described herein, a Moment of Inertia of about 2.92 $g*m^2$ as measured according to the Moment of Inertia Test Method described herein, and a Roll Density of about 0.111 $g/cm^3$ as measured according to the Roll Density Test Method described herein.

Example 1I—Toilet Tissue Roll

Two parent rolls of the web (fibrous structure) of Example 1 are converted into a sanitary tissue product roll by loading each roll of web (fibrous structure) into an unwind stand. The line speed is 400 ft/min. One parent roll of the web (fibrous structure) is unwound and transported to an emboss stand where the web (fibrous structure) is strained to form the emboss pattern in the web (fibrous structure) and then combined with the web (fibrous structure) from the other parent roll to make a multi-ply (2-ply) sanitary tissue product. The multi-ply sanitary tissue product is then transported over a slot extruder through which a surface chemistry may be applied. The multi-ply sanitary tissue product is then transported to a winder passing through a perforating station to impart a plurality of perforations into the multi-ply sanitary tissue product at about every 4 inches resulting in about 1700 sheets in the multi-ply sanitary tissue product before it is wound onto a core having an outer diameter of about 1.65 inches such that a log from which the finished sanitary tissue product rolls as described below are made is formed. The log of multi-ply sanitary tissue product is then transported to a log saw where the log is cut into finished multi-ply sanitary tissue product rolls having and a total sanitary tissue product length of about 6800 inches, a roll and sheet width of about 3.94 inches, a sheet caliper of about 19.0 mils as measured according to the Caliper Test Method described herein, and a Basis Weight of about 48 gsm as measured according to the Basis Weight Test Method for Toilet Tissue Samples described herein. At least one of the finished multi-ply sanitary tissue product roll exhibits a Roll Diameter of about 12.21 inches as measured according to the Roll Diameter Test Method described herein, a Moment of Inertia of about 10.91 $g*m^2$ as measured according to the Moment of Inertia Test Method described herein, and a Roll Density of about 0.116 $g/cm^3$ as measured according to the Roll Density Test Method described herein.

Example 1J—Toilet Tissue Roll

Two parent rolls of the web (fibrous structure) of Example 1 are converted into a sanitary tissue product roll by loading each roll of web (fibrous structure) into an unwind stand. The line speed is 400 ft/min. One parent roll of the web (fibrous structure) is unwound and transported to an emboss stand where the web (fibrous structure) is strained to form the emboss pattern in the web (fibrous structure) and then combined with the web (fibrous structure) from the other parent roll to make a multi-ply (2-ply) sanitary tissue product. The multi-ply sanitary tissue product is then transported over a slot extruder through which a surface chemistry may be applied. The multi-ply sanitary tissue product is then transported to a winder passing through a perforating station to impart a plurality of perforations into the multi-ply sanitary tissue product at about every 4 inches resulting in about 1700 sheets in the multi-ply sanitary tissue product before it is wound onto a core having an outer diameter of about 1.65 inches such that a log from which the finished sanitary tissue product rolls as described below are made is formed. The log of multi-ply sanitary tissue product is then transported to a log saw where the log is cut into finished multi-ply sanitary tissue product rolls having and a total sanitary tissue product length of about 6800 inches, a roll and sheet width of about 3.94 inches, a sheet caliper of about 19.0 mils as measured according to the Caliper Test Method described herein, and a Basis Weight of about 48 gsm as measured according to the Basis Weight Test Method for Toilet Tissue Samples described herein. At least one of the finished multi-ply sanitary tissue product roll exhibits a Roll Diameter of about 12.27 inches as measured according to the Roll Diameter Test Method described herein, a Moment of Inertia of about 11.25 $g*m^2$ as measured according to the Moment of Inertia Test Method described herein, and a Roll Density of about 0.117 $g/cm^3$ as measured according to the Roll Density Test Method described herein.

Example 1K—Toilet Tissue Roll

Two parent rolls of the web (fibrous structure) of Example 1 are converted into a sanitary tissue product roll by loading each roll of web (fibrous structure) into an unwind stand. The line speed is 400 ft/min. One parent roll of the web (fibrous structure) is unwound and transported to an emboss stand where the web (fibrous structure) is strained to form the emboss pattern in the web (fibrous structure) and then combined with the web (fibrous structure) from the other parent roll to make a multi-ply (2-ply) sanitary tissue product. The multi-ply sanitary tissue product is then transported over a slot extruder through which a surface chemistry may be applied. The multi-ply sanitary tissue product is then transported to a winder passing through a perforating station to impart a plurality of perforations into the multi-ply sanitary tissue product at about every 4 inches resulting in about 2550 sheets in the multi-ply sanitary tissue product before it is wound onto a core having an outer diameter of about 1.65 inches such that a log from which the finished sanitary tissue product rolls as described below are made is formed. The log of multi-ply sanitary tissue product is then transported to a log saw where the log is cut into finished multi-ply sanitary tissue product rolls having and a total sanitary tissue product length of about 10,200 inches, a roll and sheet width of about 3.94 inches, a sheet caliper of 19.0 mils as measured according to the Caliper Test Method described herein, and a Basis Weight of about 48 gsm as measured according to the Basis Weight Test Method for Toilet Tissue Samples described herein. At least one of the finished multi-ply sanitary tissue product roll exhibits a Roll Diameter of about 15.18 inches as measured according to the Roll Diameter Test Method described herein, a Moment of Inertia of about 23.67 $g*m^2$ as measured according to the Moment of Inertia Test Method described herein, and a Roll Density of about 0.109 g/cm$^3$ as measured according to the Roll Density Test Method described herein.

Example 2—Paper Towel

The following Example illustrates a non-limiting example for a preparation of a sanitary tissue product roll comprising a web comprising a fibrous structure ply according to the present Paper towels are produced utilizing a cellulose furnish consisting of a Northern Softwood Kraft (NSK) and Eucalyptus Hardwood (EUC) at a ratio of approximately 70/30. The NSK is refined as needed to maintain target wet burst at the reel. Any furnish preparation and refining methodology common to the papermaking industry can be utilized.

A 3% active solution Kymene 1142 is added to the refined NSK line prior to an in-line static mixer and 1% active solution of Advantage DF285, an ethoxylated fatty alcohol defoamer available from Ashland Inc. is added to the EUC furnish. The addition levels are 21 and 1 lbs active/ton of paper, respectively.

The NSK and EUC thick stocks are then blended into a single thick stock line followed by addition of 1% active carboxymethylcellulose (CMC) solution at 7 and 1 lbs active/ton of paper towel, and optionally, a softening agent may be added.

The thick stock is then diluted with white water at the inlet of a fan pump to a consistency of about 0.15% based on total weight of NSK and EUC fiber. The diluted fiber slurry is directed to a non-layered configuration headbox such that a wet web is formed onto a Fourdrinier wire (foraminous wire).

Dewatering occurs through the Fourdrinier wire and is assisted by deflector and vacuum boxes. The Fourdrinier wire is of a 5-shed, satin weave configuration having 87 machine-direction and 76 cross-direction monofilaments per inch, respectively. The speed of the Fourdrinier wire is about 750 fpm (feet per minute).

The embryonic wet web is transferred from the Fourdrinier wire at a fiber consistency of about 24% at the point of transfer, to a patterned belt through-air-drying resin carrying fabric. To provide webs of the present invention, the speed of the patterned through-air-drying fabric is approximately the same as the speed of the Fourdrinier wire. In another example, the embryonic wet web may be transferred to a patterned belt and/or fabric that is traveling slower, for example about 20% slower than the speed of the Fourdrinier wire (for example a wet molding process).

Further de-watering is accomplished by vacuum assisted drainage until the web has a fiber consistency of about 30%.

While remaining in contact with the patterned drying fabric, the web is pre-dried by air blow-through pre-dryers to a fiber consistency of about 65% by weight.

After the pre-dryers, the semi-dry web is transferred to a Yankee dryer and adhered to the surface of the Yankee dryer with a sprayed creping adhesive. The creping adhesive is an aqueous dispersion with the actives consisting of about 22% polyvinyl alcohol, about 11% CREPETROL® A3025, and about 67% CREPETROL® R6390. CREPETROL® A3025 and CREPETROL® R6390 are commercially available from Ashland Inc. (formerly Hercules Inc.). The creping adhesive is delivered to the Yankee surface at a rate of about 0.15% adhesive solids based on the dry weight of the web. The fiber consistency is increased to about 97% before the web is dry creped from the Yankee with a doctor blade.

The doctor blade has a bevel angle of about 25° and is positioned with respect to the Yankee dryer to provide an impact angle of about 81°. The Yankee dryer is operated at a temperature of about 177° C. and a speed of about 800 fpm. The fibrous structure is wound in a roll using a surface driven reel drum having a surface speed of about 656 feet per minute. In another example, the doctor blade may have a bevel angle of about 45° and is positioned with respect to the Yankee dryer to provide an impact angle of about 101° and the reel may be run at a speed that is about 15% faster than the speed of the Yankee.

Example 2A—Paper Towel Roll

Two parent rolls of the web (fibrous structure) of Example 2 are converted into a sanitary tissue product roll by loading each roll of web (fibrous structure) into an unwind stand. The line speed is 400 ft/min. One parent roll of the web (fibrous structure) is unwound and transported to an emboss stand where the web (fibrous structure) is strained to form the emboss pattern in the web (fibrous structure) and then combined with the web (fibrous structure) from the other parent roll to make a multi-ply (2-ply) sanitary tissue product. The multi-ply sanitary tissue product is then transported over a slot extruder through which a surface chemistry may be applied. The multi-ply sanitary tissue product is then transported to a winder passing through a perforating station to impart a plurality of perforations into the multi-ply sanitary tissue product at about every 10.2 inches for full sheets (alternatively it could be about every 5.7 to 7.1 inches for Select-a-Size sheets and/or alternating between full sheets and Select-a-Size sheets within a roll) resulting in about 350 sheets in the multi-ply sanitary tissue product before it is wound onto a core having an outer diameter of about 1.65 inches such that a log from which the finished sanitary tissue product rolls as described below are made is formed. The log of multi-ply sanitary tissue product is then transported to a log saw where the log is cut into finished multi-ply sanitary tissue product rolls having and a total sanitary tissue product length of about 3570 inches, a roll and sheet width of about 11.00 inches, a sheet caliper of about 25.5 mils as measured according to the Caliper Test Method described herein, and a Basis Weight of about 55 gsm as measured according to the Basis Weight Test Method for Paper Towel Samples described herein. At least one of the finished multi-ply sanitary tissue product roll exhibits a Roll Diameter of about 9.95 inches as measured according to the Roll Diameter Test Method described herein, a Moment of Inertia of about 6.67 g*m$^2$ as measured according to the Moment of Inertia Test Method described herein, and a Roll Density of about 0.060 g/cm$^3$ as measured according to the Roll Density Test Method described herein.

Example 2B—Paper Towel Roll

Two parent rolls of the web (fibrous structure) of Example 2 are converted into a sanitary tissue product roll by loading each roll of web (fibrous structure) into an unwind stand. The line speed is 400 ft/min. One parent roll of the web (fibrous structure) is unwound and transported to an emboss stand where the web (fibrous structure) is strained to form the emboss pattern in the web (fibrous structure) and then combined with the web (fibrous structure) from the other parent roll to make a multi-ply (2-ply) sanitary tissue product. The multi-ply sanitary tissue product is then transported over a slot extruder through which a surface chemistry may be applied. The multi-ply sanitary tissue product is then transported to a winder passing through a perforating station to impart a plurality of perforations at about every 10.2 inches for full sheets (alternatively it could be about every 5.7 to 7.1 inches for Select-a-Size sheets and/or alternating between full sheets and Select-a-Size sheets within a roll) resulting in about 158 sheets in the multi-ply sanitary tissue product before it is wound onto a core having an outer diameter of about 1.65 inches such that a log from which the finished sanitary tissue product rolls as described below are made is formed. The log of multi-ply sanitary tissue product is then transported to a log saw where the log is cut into finished multi-ply sanitary tissue product rolls having a total sanitary tissue product length of about 1611 inches, a roll and sheet width of about 11.00 inches, a sheet caliper of about 25.5 mils as measured according to the Caliper Test Method described herein, and a Basis Weight of about 55 gsm as measured according to the Basis Weight Test Method for Paper Towel Samples described herein. At least one of the finished multi-ply sanitary tissue product roll exhibits a Roll Diameter of about 7.01 inches as measured according to the Roll Diameter Test Method described herein, a Moment of Inertia of about 1.63 $g*m^2$ as measured according to the Moment of Inertia Test Method described herein, and a Roll Density of about 0.059 $g/cm^3$ as measured according to the Roll Density Test Method described herein.

Example 2C—Paper Towel Roll

Two parent rolls of the web (fibrous structure) of Example 2 are converted into a sanitary tissue product roll by loading each roll of web (fibrous structure) into an unwind stand. The line speed is 400 ft/min. One parent roll of the web (fibrous structure) is unwound and transported to an emboss stand where the web (fibrous structure) is strained to form the emboss pattern in the web (fibrous structure) and then combined with the web (fibrous structure) from the other parent roll to make a multi-ply (2-ply) sanitary tissue product. The multi-ply sanitary tissue product is then transported over a slot extruder through which a surface chemistry may be applied. The multi-ply sanitary tissue product is then transported to a winder passing through a perforating station to impart a plurality of perforations at about every 10.2 inches for full sheets (alternatively it could be about every 5.7 to 7.1 inches for Select-a-Size sheets and/or alternating between full sheets and Select-a-Size sheets within a roll) resulting in about 211 sheets in the multi-ply sanitary tissue product before it is wound onto a core having an outer diameter of about 1.65 inches such that a log from which the finished sanitary tissue product rolls as described below are made is formed. The log of multi-ply sanitary tissue product is then transported to a log saw where the log is cut into finished multi-ply sanitary tissue product rolls having a total sanitary tissue product length of about 2152 inches, a roll and sheet width of about 11.00 inches, a sheet caliper of about 25.5 mils as measured according to the Caliper Test Method described herein, and a Basis Weight of about 55 gsm as measured according to the Basis Weight Test Method for Paper Towel Samples described herein. At least one of the finished multi-ply sanitary tissue product roll exhibits a Roll Diameter of about 7.92 inches as measured according to the Roll Diameter Test Method described herein, a Moment of Inertia of about 2.52 $g*m^2$ as measured according to the Moment of Inertia Test Method described herein, and a Roll Density of about 0.056 $g/cm^3$ as measured according to the Roll Density Test Method described herein.

Example 2D—Paper Towel Roll

Two parent rolls of the web (fibrous structure) of Example 2 are converted into a sanitary tissue product roll by loading each roll of web (fibrous structure) into an unwind stand. The line speed is 400 ft/min. One parent roll of the web (fibrous structure) is unwound and transported to an emboss stand where the web (fibrous structure) is strained to form the emboss pattern in the web (fibrous structure) and then combined with the web (fibrous structure) from the other parent roll to make a multi-ply (2-ply) sanitary tissue product. The multi-ply sanitary tissue product is then transported over a slot extruder through which a surface chemistry may be applied. The multi-ply sanitary tissue product is then transported to a winder passing through a perforating station to impart a plurality of perforations at about every 10.2 inches for full sheets (alternatively it could be about every 5.7 to 7.1 inches for Select-a-Size sheets and/or alternating between full sheets and Select-a-Size sheets within a roll) resulting in about 350 sheets in the multi-ply sanitary tissue product before it is wound onto a core having an outer diameter of about 1.65 inches such that a log from which the finished sanitary tissue product rolls as described below are made is formed. The log of multi-ply sanitary tissue product is then transported to a log saw where the log is cut into finished multi-ply sanitary tissue product rolls having a total sanitary tissue product length of about 3570 inches, a roll and sheet width of about 11.00 inches, a sheet caliper of about 25.5 mils as measured according to the Caliper Test Method described herein, and a Basis Weight of about 55 gsm as measured according to the Basis Weight Test Method for Paper Towel Samples described herein. At least one of the finished multi-ply sanitary tissue product roll exhibits a Roll Diameter of about 10.03 inches as measured according to the Roll Diameter Test Method described herein, a Moment of Inertia of about 6.99 $g*m^2$ as measured according to the Moment of Inertia Test Method described herein, and a Roll Density of about 0.061 $g/cm^3$ as measured according to the Roll Density Test Method described herein.

Test Methods

Unless otherwise specified, all tests described herein including those described under the Definitions section and the following test methods are conducted on samples that have been conditioned in a conditioned room at a temperature of 23° C.±1.0° C. and a relative humidity of 50% ±2% for a minimum of 2 hours prior to the test. The samples tested are "usable units." "Usable units" as used herein means sheets, flats from roll stock, pre-converted flats, and/or single or multi-ply products unless otherwise stated. All tests are conducted in such conditioned room. Do not test samples that have defects such as wrinkles, tears, holes, and like. All instruments are calibrated according to manufacturer's specifications.

Roll Diameter Test Method

For this test, the actual sanitary tissue product roll is the test sample. Remove all of the test sanitary tissue product rolls from any packaging and allow them to condition at about 23° C.±2 C.° and about 50%±2% relative humidity for 24 hours prior to testing. Rolls with cores that are crushed, bent or damaged should not be tested.

The diameter of the test sanitary tissue product roll is measured directly using a Pi® tape of appropriate length or equivalent precision diameter tape (e.g. an Executive Diameter tape available from Apex Tool Group, LLC, Apex, N.C., Model No. W606PD) which converts the circumferential distance into a diameter measurement, so the roll diameter is directly read from the scale. The diameter tape is graduated to 0.01 inch increments. The tape is 0.25 in wide and is made of flexible metal that conforms to the curvature of the test sanitary tissue product roll but is not elongated under the loading used for this test.

Loosely loop the diameter tape around the circumference of the test sanitary tissue product roll, placing the tape edges directly adjacent to each other with the surface of the tape lying flat against the test sanitary tissue product roll. Pull the tape snug against the circumference of the test sanitary tissue product roll, applying approximately 100 g of force. Wait 3 seconds. At the intersection of the diameter tape, read the diameter aligned with the zero mark of the diameter tape and record as the Roll Diameter to the nearest 0.01 inches. The outer radius of the sanitary tissue product roll is also calculated from this test method.

In like fashion analyze a total of ten (10) replicate sample sanitary tissue product rolls. Calculate the arithmetic mean of the 10 values and report the Roll Diameter to the nearest 0.01 inches.

Moment of Inertia Test Method

For this test, the actual sanitary tissue product roll is the test sample. Remove all of the test sanitary tissue product rolls from any packaging and allow them to condition at about 23° C.±2 C.° and about 50%±2% relative humidity for 24 hours prior to testing. Rolls with cores that are crushed, bent or damaged should not be tested.

The Moment of Inertia of a roll is calculated using the following equation:

$$\text{Moment of Inertia } (g \cdot m^2) = \frac{\text{Mass (g)}}{2}[\text{Outer Radius (m)}^2 + \text{Inner Radius (m)}^2]$$

Figure 10:
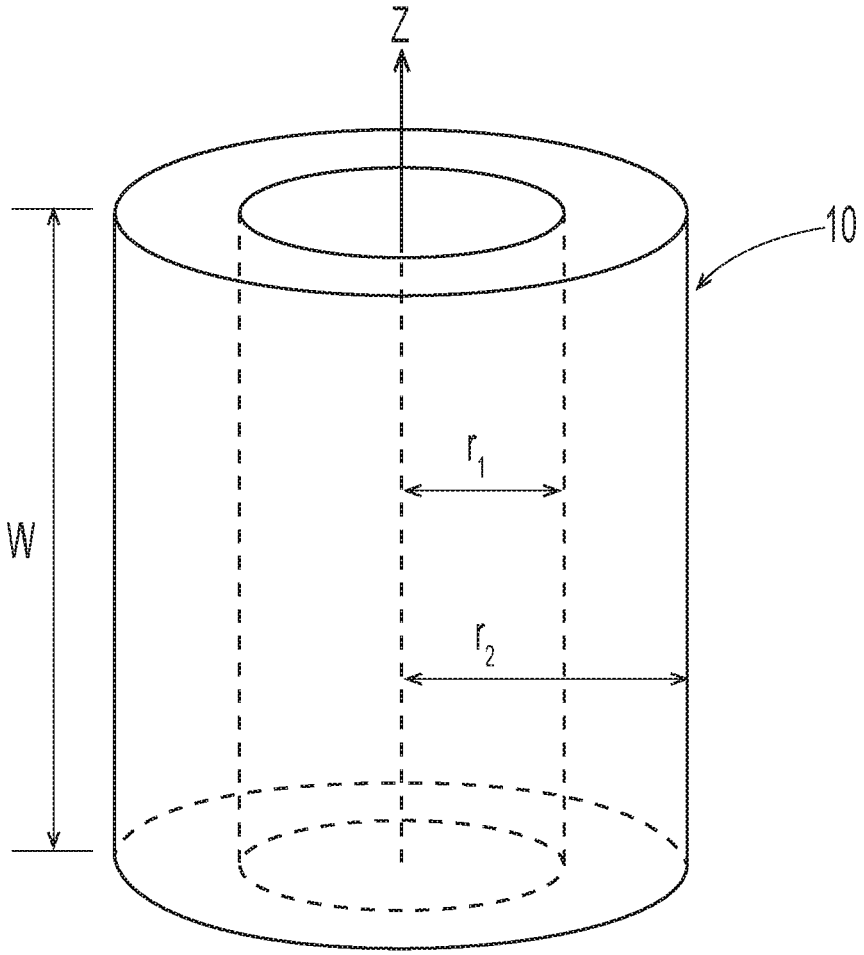
FIG. 10 is a schematic representation of a sanitary tissue product roll for use in measuring a sanitary tissue product roll's Roll Density as measured according to the Roll Density Test Method described herein and Moment of Inertia as measured according to the Moment of Inertia Test Method described herein.

FIG. 10 visually describes the measurement of a sanitary tissue product roll 10 where Z is the center axis of the roll, where the outer radius $r_2$ in units of m is measured using the Roll Diameter Test Method described herein, the inner radius $r_1$ in units of m is measured using a caliper tool, and the mass in units of g is the weight of the entire roll including core.

In like fashion analyze a total of ten (10) replicate sample sanitary tissue product rolls. Calculate the arithmetic mean of the 10 values and report the Moment of Inertia to the nearest 0.01 $g*m^2$.

Roll Density Test Method

For this test, the actual sanitary tissue product roll is the test sample. Remove all of the test sanitary tissue product rolls from any packaging and allow them to condition at about 23° C.±2 C.° and about 50%±2% relative humidity for 24 hours prior to testing. Rolls with cores that are crushed, bent or damaged should not be tested.

The Roll Density is calculated by dividing the mass the roll by its volume using the following equation:

$$\text{Roll Density } \left(\frac{g}{cm^2}\right) =$$

-continued $$\frac{\text{Mass (g)}}{\text{Roll Width (cm)} \cdot \pi[\text{Outer Radius (cm)}^2 - \text{Inner Radius (cm)}^2]}$$

FIG. 10 visually describes the measurement of a sanitary tissue product roll 10 where Z is the center axis of the roll, where the outer radius $r_2$ in units of cm is measured using the Roll Diameter Test Method described herein, the inner radius $r_1$ in units of cm is measured using a caliper tool, the roll width W is measured using a ruler or tape measure in units of cm and the mass in units of g is the weight of the entire roll including core.

In like fashion analyze a total of ten (10) replicate sample rolls. Calculate the arithmetic mean of the 10 values and report the Roll Density to the nearest 0.001 $g/cm^3$.

Basis Weight Test Method for Toilet Tissue Samples

Basis weight of a fibrous structure and/or sanitary tissue product is measured on stacks of twelve usable units using a top loading analytical balance with a resolution of ±0.001 g. The balance is protected from air drafts and other disturbances using a draft shield. A precision cutting die, measuring 3.500 in±0.007 in by 3.500 in±0.007 in is used to prepare all samples.

Stack six usable units aligning any perforations or folds on the same side of stack. With a precision cutting die, cut the stack into squares. Select six more usable units of the sample; stack and cut in like manner. Combine the two stacks to form a single stack twelve squares thick. Measure the mass of the sample stack and record the result to the nearest 0.001 g.

The Basis Weight is calculated in lbs/3000 $ft^2$ or $g/m^2$ as follows:

Basis Weight=(Mass of stack)/[(Area of 1 layer in stack)×(Number of layers)]

For example,

Basis Weight (lbs/3000 $ft^2$)=[[Mass of stack (g)/453.6 (g/lbs)]/[12.25 ($in^2$)/144($in^2/ft^2$)×12]]×3000

Or,

Basis Weight ($g/m^2$)=Mass of stack (g)/[79.032 ($cm^2$)/10,000 ($cm^2/m^2$)×12]

Report result to the nearest 0.1 lbs/3000 $ft^2$ or 0.1 $g/m^2$. Sample dimensions can be changed or varied using a similar precision cutter as mentioned above, so as at least 100 square inches of sample area in stack.

Basis Weight Test Method for Paper Towel Samples

Basis weight of a fibrous structure and/or sanitary tissue product is measured on stacks of twelve usable units using a top loading analytical balance with a resolution of ±0.001 g. The balance is protected from air drafts and other disturbances using a draft shield. A precision cutting die, measuring 4.000 in±0.008 in by 4.000 in±0.008 in is used to prepare all samples.

Stack eight usable units aligning any perforations or folds on the same side of stack. With a precision cutting die, cut the stack into squares. Measure the mass of the sample stack and record the result to the nearest 0.001 g.

The Basis Weight is calculated in lbs/3000 $ft^2$ or $g/m^2$ as follows:

Basis Weight=(Mass of stack)/[(Area of 1 layer in stack)×(Number of layers)]

For example,

Basis Weight (lbs/3000 $ft^2$)=[[Mass of stack (g)/453.6 (g/lbs)]/[16 ($in^2$)/144 ($in^2/ft^2$)×8]]×3000

Or,

Basis Weight ($g/m^2$)=Mass of stack (g)/[103.23 ($cm^2$)/10,000 ($cm^2/m^2$)×8]

Report result to the nearest 0.1 lbs/3000 $ft^2$ or 0.1 $g/m^2$. Sample dimensions can be changed or varied using a similar precision cutter as mentioned above, so as at least 100 square inches of sample area in stack.

Caliper Test Method

Caliper of a sanitary tissue product or web is measured using a ProGage Thickness Tester (Thwing-Albert Instrument Company, West Berlin, N.J.) with a pressure foot diameter of 2.00 inches (area of 3.14 $in^2$) at a pressure of 95 $g/in^2$. Four (4) samples are prepared by cutting of a usable unit such that each cut sample is at least 2.5 inches per side, avoiding creases, folds, and obvious defects. An individual specimen is placed on the anvil with the specimen centered underneath the pressure foot. The foot is lowered at 0.03 in/sec to an applied pressure of 95 $g/in^2$. The reading is taken after 3 sec dwell time, and the foot is raised. The measure is repeated in like fashion for the remaining 3 specimens. The caliper is calculated as the average caliper of the four specimens and is reported in mils (0.001 in) to the nearest 0.1 mils.

Dry Tensile Strength Test Method for Toilet Tissue Samples

Elongation, Tensile Strength, TEA and Tangent Modulus are measured on a constant rate of extension tensile tester with computer interface (a suitable instrument is the EJA Vantage from the Thwing-Albert Instrument Co. Wet Berlin, N.J.) using a load cell for which the forces measured are within 10% to 90% of the limit of the load cell. Both the movable (upper) and stationary (lower) pneumatic jaws are fitted with smooth stainless steel faced grips, with a design suitable for testing 1 inch wide sheet material (Thwing-Albert item #733GC). An air pressure of about 60 psi is supplied to the jaws.

Twenty usable units of sanitary tissue product or web are divided into four stacks of five usable units each. The usable units in each stack are consistently oriented with respect to machine direction (MD) and cross direction (CD). Two of the stacks are designated for testing in the MD and two for CD. Using a one inch precision cutter (Thwing Albert) take a CD stack and cut two, 1.00 in±0.01 in wide by at least 3.0 in long strips from each CD stack (long dimension in CD). Each strip is five usable unit layers thick and will be treated as a unitary specimen for testing. In like fashion cut the remaining CD stack and the two MD stacks (long dimension in MD) to give a total of 8 specimens (five layers each), four CD and four MD.

Program the tensile tester to perform an extension test, collecting force and extension data at an acquisition rate of 20 Hz as the crosshead raises at a rate of 4.00 in/min (10.16 cm/min) until the specimen breaks. The break sensitivity is set to 50%, i.e., the test is terminated when the measured force drops to 50% of the maximum peak force, after which the crosshead is returned to its original position.

Set the gage length to 2.00 inches. Zero the crosshead and load cell. Insert the specimen into the upper and lower open grips such that at least 0.5 inches of specimen length is contained each grip. Align specimen vertically within the upper and lower jaws, then close the upper grip. Verify specimen is aligned, then close lower grip. The specimen should be under enough tension to eliminate any slack, but less than 0.05 N of force measured on the load cell. Start the tensile tester and data collection. Repeat testing in like fashion for all four CD and four MD specimens.

Program the software to calculate the following from the constructed force (g) verses extension (in) curve:

Tensile Strength is the maximum peak force (g) divided by the product of the specimen width (1 in) and the number of usable units in the specimen (5), and then reported as g/in to the nearest 1 g/in.

Adjusted Gage Length is calculated as the extension measured at 11.12 g of force (in) added to the original gage length (in).

Elongation is calculated as the extension at maximum peak force (in) divided by the Adjusted Gage Length (in) multiplied by 100 and reported as % to the nearest 0.1%.

Tensile Energy Absorption (TEA) is calculated as the area under the force curve integrated from zero extension to the extension at the maximum peak force (g*in), divided by the product of the adjusted Gage Length (in), specimen width (in), and number of usable units in the specimen (5). This is reported as $g*in/in^2$ to the nearest 1 $g*in/in^2$.

Replot the force (g) verses extension (in) curve as a force (g) verses strain curve. Strain is herein defined as the extension (in) divided by the Adjusted Gage Length (in).

Program the software to calculate the following from the constructed force (g) verses strain curve:

Tangent Modulus is calculated as the least squares linear regression using the first data point from the force (g) verses strain curve recorded after 190.5 g (38.1 g×5 layers) force and the 5 data points immediately preceding and the 5 data points immediately following it. This slope is then divided by the product of the specimen width (2.54 cm) and the number of usable units in the specimen (5), and then reported to the nearest 1 g/cm.

The Tensile Strength (g/in), Elongation (%), TEA ($g*in/in^2$) and Tangent Modulus (g/cm) are calculated for the four CD specimens and the four MD specimens. Calculate an average for each parameter separately for the CD and MD specimens.

Calculations:

Geometric Mean Tensile=Square Root of [*MD* Tensile Strength (g/in)×*CD* Tensile Strength (g/in)]

Geometric Mean Peak Elongation=Square Root of [*MD* Elongation (%)×*CD* Elongation (%)]

Geometric Mean TEA=Square Root of [*MD* TEA ($g*in/in^2$)×*CD* TEA ($g*in/in^2$)]

Geometric Mean Modulus=Square Root of [*MD* Modulus (g/cm)×*CD* Modulus (g/cm)]

Total Dry Tensile Strength (TDT)=*MD* Tensile Strength (g/in)+*CD* Tensile Strength (g/in)

Total TEA=*MD* TEA ($g*in/in^2$)+*CD* TEA ($g*in/in^2$)

Total Modulus=*MD* Modulus (g/cm)+*CD* Modulus (g/cm)

Tensile Ratio=*MD* Tensile Strength (g/in)/*CD* Tensile Strength (g/in)

Dry Tensile Strength Test Method for Paper Towel Samples

Elongation, Tensile Strength, TEA and Tangent Modulus are measured on a constant rate of extension tensile tester with computer interface (a suitable instrument is the EJA Vantage from the Thwing-Albert Instrument Co. Wet Berlin, N.J.) using a load cell for which the forces measured are within 10% to 90% of the limit of the load cell. Both the movable (upper) and stationary (lower) pneumatic jaws are fitted with smooth stainless steel faced grips, with a design suitable for testing 1 inch wide sheet material (Thwing-Albert item #733GC). An air pressure of about 60 psi is supplied to the jaws.

Eight usable units of sanitary tissue product or web are divided into two stacks of four usable units each. The usable units in each stack are consistently oriented with respect to machine direction (MD) and cross direction (CD). One of the stacks is designated for testing in the MD and the other for CD. Using a one inch precision cutter (Thwing Albert) take a CD stack and cut one, 1.00 in±0.01 in wide by at least 5.0 in long stack of strips (long dimension in CD). In like fashion cut the remaining stack in the MD (strip long dimension in MD), to give a total of 8 specimens, four CD and four MD strips. Each strip to be tested is one usable unit thick and will be treated as a unitary specimen for testing.

Program the tensile tester to perform an extension test, collecting force and extension data at an acquisition rate of 20 Hz as the crosshead raises at a rate of 4.00 in/min (10.16 cm/min) until the specimen breaks. The break sensitivity is set to 50%, i.e., the test is terminated when the measured force drops to 50% of the maximum peak force, after which the crosshead is returned to its original position.

Set the gage length to 4.00 inches. Zero the crosshead and load cell. Insert the specimen into the upper and lower open grips such that at least 0.5 inches of specimen length is contained each grip. Align specimen vertically within the upper and lower jaws, then close the upper grip. Verify specimen is aligned, then close lower grip. The specimen should be under enough tension to eliminate any slack, but less than 0.05 N of force measured on the load cell. Start the tensile tester and data collection. Repeat testing in like fashion for all four CD and four MD specimens.

Program the software to calculate the following from the constructed force (g) verses extension (in) curve:

Tensile Strength is the maximum peak force (g) divided by the specimen width (1 in), and reported as g/in to the nearest 1 g/in.

Adjusted Gage Length is calculated as the extension measured at 11.12 g of force (in) added to the original gage length (in).

Elongation is calculated as the extension at maximum peak force (in) divided by the Adjusted Gage Length (in) multiplied by 100 and reported as % to the nearest 0.1%.

Tensile Energy Absorption (TEA) is calculated as the area under the force curve integrated from zero extension to the extension at the maximum peak force (g*in), divided by the product of the adjusted Gage Length (in) and specimen width (in). This is reported as g*in/in$^2$ to the nearest 1 g*in/in$^2$.

Replot the force (g) verses extension (in) curve as a force (g) verses strain curve. Strain is herein defined as the extension (in) divided by the Adjusted Gage Length (in).

Program the software to calculate the following from the constructed force (g) verses strain curve:

Tangent Modulus is calculated as the least squares linear regression using the first data point from the force (g) verses strain curve recorded after 38.1 g force and the 5 data points immediately preceding and the 5 data points immediately following it. This slope is then divided by the specimen width (2.54 cm), and then reported to the nearest 1 g/cm.

The Tensile Strength (g/in), Elongation (%), TEA (g*in/in$^2$) and Tangent Modulus (g/cm) are calculated for the four CD specimens and the four MD specimens. Calculate an average for each parameter separately for the CD and MD specimens.

Calculations:

Geometric Mean Tensile=Square Root of [*MD* Tensile Strength (g/in)×*CD* Tensile Strength (g/in)]

Geometric Mean Peak Elongation=Square Root of [*MD* Elongation (%)×*CD* Elongation (%)]

Geometric Mean TEA=Square Root of [*MD* TEA (g*in/in$^2$)×*CD* TEA (g*in/in$^2$)]

Geometric Mean Modulus=Square Root of [*MD* Modulus (g/cm)×*CD* Modulus (g/cm)]

Total Dry Tensile Strength (TDT)=*MD* Tensile Strength (g/in)+*CD* Tensile Strength (g/in)

Total TEA=*MD* TEA (g*in/in$^2$)+*CD* TEA (g*in/in$^2$)

Total Modulus=*MD* Modulus (g/cm)+*CD* Modulus (g/cm)

Tensile Ratio=*MD* Tensile Strength (g/in)/*CD* Tensile Strength (g/in)

Wet Tensile Test Method

The Wet Tensile Strength test method is utilized for the determination of the wet tensile strength of a sanitary tissue product or web strip after soaking with water, using a tensile-strength-testing apparatus operating with a constant rate of elongation. The Wet Tensile Strength test is run according to ISO 12625-5:2005, except for any deviations or modifications described below. This method uses a vertical tensile-strength tester, in which a device that is held in the lower grip of the tensile-strength tester, called a Finch Cup, is used to achieve the wetting.

Using a one inch JDC precision sample cutter (Thwing Albert) cut six 1.00 in±0.01 in wide strips from a sanitary tissue product sheet or web sheet in the machine direction (MD), and six strips in the cross machine direction (CD). An electronic tensile tester (Model 1122, Instron Corp., or equivalent) is used and operated at a crosshead speed of 1.0 inch (about 1.3 cm) per minute and a gauge length of 1.0 inch (about 2.5 cm). The two ends of the strip are placed in the upper jaws of the machine, and the center of the strip is placed around a stainless steel peg. The strip is soaked in distilled water at about 20° C. for the identified soak time, and then measured for peak tensile strength. Reference to a machine direction means that the sample being tested is prepared such that the length of the strip is cut parallel to the machine direction of manufacture of the product.

The MD and CD wet peak tensile strengths are determined using the above equipment and calculations in the conventional manner The reported value is the arithmetic average of the six strips tested for each directional strength to the nearest 0.1 grams force. The total wet tensile strength for a given soak time is the arithmetic total of the MD and CD tensile strengths for that soak time. Initial total wet tensile strength ("ITWT") is measured when the paper has been submerged for 5±0.5 seconds. Decayed total wet tensile ("DTWT") is measured after the paper Wet Decay Test Method Wet decay (loss of wet tensile) for a sanitary tissue product or web is measured according to the Wet Tensile Test Method described herein and is the wet tensile of the sanitary tissue product or web after it has been standing in the soaked condition in the Finch Cup for 30 minutes. Wet decay is reported in units of "%". Wet decay is the % loss of Initial Total Wet Tensile after the 30 minute soaking.

Dry Burst Test Method

The Dry Burst Test is run according to ISO 12625-9:2005, except for any deviations described below. Sanitary tissue product samples or web samples for each condition to be tested are cut to a size appropriate for testing, a minimum of five (5) samples for each condition to be tested are prepared.

A burst tester (Burst Tester Intelect-II-STD Tensile Test Instrument, Cat. No. 1451-24PGB available from Thwing-Albert Instrument Co., Philadelphia, Pa., or equivalent) is set up according to the manufacturer's instructions and the following conditions: Speed: 12.7 centimeters per minute; Break Sensitivity: 20 grams; and Peak Load: 2000 grams. The load cell is calibrated according to the expected burst strength.

A sanitary tissue product sample or web sample to be tested is clamped and held between the annular clamps of the burst tester and is subjected to increasing force that is applied by a 0.625 inch diameter, polished stainless steel ball upon operation of the burst tester according to the manufacturer's instructions. The burst strength is that force that causes the sample to fail.

The burst strength for each sanitary tissue product sample or web sample is recorded. An average and a standard deviation for the burst strength for each condition is calculated.

The Dry Burst is reported as the average and standard deviation for each condition to the nearest gram.

Wet Burst Test Method

"Wet Burst Strength" as used herein is a measure of the ability of a sanitary tissue product or web to absorb energy, when wet and subjected to deformation normal to the plane of the sanitary tissue product or web. The Wet Burst Test is run according to ISO 12625-9:2005, except for any deviations or modifications described below.

Wet burst strength may be measured using a Thwing-Albert Burst Tester Cat. No. 177 equipped with a 2000 g load cell commercially available from Thwing-Albert Instrument Company, Philadelphia, Pa., or an equivalent instrument.

Wet burst strength is measured by preparing four (4) sanitary tissue product samples or web samples for testing. First, condition the samples for two (2) hours at a temperature of 73° F.±2° F. (23° C.±1° C.) and a relative humidity of 50% (±2%). Take one sample and horizontally dip the center of the sample into a pan filled with about 25 mm of room temperature distilled water. Leave the sample in the water four (4) (±0.5) seconds. Remove and drain for three (3) (±0.5) seconds holding the sample vertically so the water runs off in the cross machine direction. Proceed with the test immediately after the drain step.

Place the wet sample on the lower ring of the sample holding device of the Burst Tester with the outer surface of the sample facing up so that the wet part of the sample completely covers the open surface of the sample holding ring. If wrinkles are present, discard the samples and repeat with a new sample. After the sample is properly in place on the lower sample holding ring, turn the switch that lowers the upper ring on the Burst Tester. The sample to be tested is now securely gripped in the sample holding unit. Start the burst test immediately at this point by pressing the start button on the Burst Tester. A plunger will begin to rise (or lower) toward the wet surface of the sample. At the point when the sample tears or ruptures, report the maximum reading. The plunger will automatically reverse and return to its original starting position. Repeat this procedure on three (3) more samples for a total of four (4) tests, i.e., four (4) replicates. Report the results as an average of the four (4) replicates, to the nearest gram.

Figure 11:
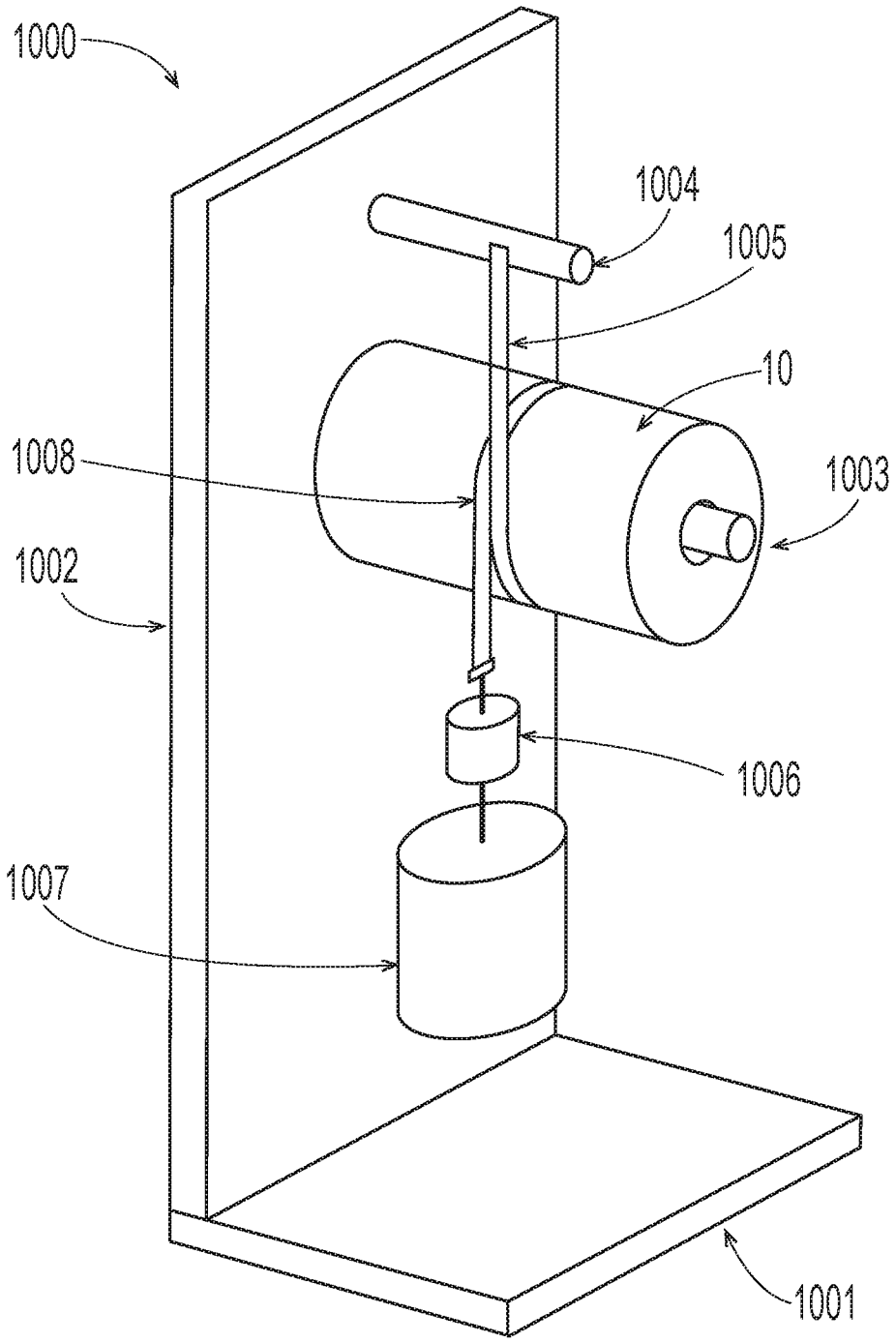
FIG. 11 is a schematic representation of the testing device used in the Roll Compressibility Test Method described herein.

Percent Compressibility Test Method for Toilet Tissue Roll and Paper Towel Roll Samples Percent Roll Compressibility (Percent Compressibility) is determined using the Roll Tester 1000 as shown in FIG. 11. It is comprised of a support stand made of two aluminum plates, a base plate 1001 and a vertical plate 1002 mounted perpendicular to the base, a sample shaft 1003 to mount the test roll, and a bar 1004 used to suspend a precision diameter tape 1005 that wraps around the circumference of the test roll. Two different weights 1006 and 1007 are suspended from the diameter tape to apply a confining force during the uncompressed and compressed measurement. All testing is performed in a conditioned room maintained at about 23° C.±2° C. and about 50%±2% relative humidity.

The diameter of the test roll, for example a sanitary tissue product roll 10, is measured directly using a Pi® tape or equivalent precision diameter tape (e.g. an Executive Diameter tape available from Apex Tool Group, LLC, Apex, N.C., Model No. W606PD) which converts the circumferential distance into a diameter measurement, so the roll diameter is directly read from the scale. The diameter tape is graduated to 0.01 inch increments with accuracy certified to 0.001 inch and traceable to NIST. The tape is 0.25 in wide and is made of flexible metal that conforms to the curvature of the test roll but is not elongated under the 1100 g loading used for this test. If necessary the diameter tape is shortened from its original length to a length that allows both of the attached weights to hang freely during the test yet is still long enough to wrap completely around the test roll being measured. The cut end of the tape is modified to allow for hanging of a weight (e.g. a loop). All weights used are calibrated, Class F hooked weights, traceable to NIST.

The aluminum support stand is approximately 600 mm tall and stable enough to support the test roll horizontally throughout the test. The sample shaft 1003 is a smooth aluminum cylinder that is mounted perpendicularly to the vertical plate 1002 approximately 485 mm from the base. The shaft has a diameter that is at least 90% of the inner diameter of the roll and longer than the width of the roll. A small steal bar 1004 approximately 6.3 mm diameter is mounted perpendicular to the vertical plate 1002 approximately 570 mm from the base and vertically aligned with the sample shaft. The diameter tape is suspended from a point along the length of the bar corresponding to the midpoint of a mounted test roll. The height of the tape is adjusted such that the zero mark is vertically aligned with the horizontal midline of the sample shaft when a test roll is not present.

Condition the samples at about 23° C.±2° C. and about 50%±2% relative humidity for 2 hours prior to testing. Rolls with cores that are crushed, bent or damaged should not be tested. Place the test roll on the sample shaft 1003 such that the direction the paper was rolled onto its core is the same direction the diameter tape will be wrapped around the test roll. Align the midpoint of the roll's width with the suspended diameter tape. Loosely loop the diameter tape 1004 around the circumference of the roll, placing the tape edges directly adjacent to each other with the surface of the tape lying flat against the test sample. Carefully, without applying any additional force, hang the 100 g weight 1006 from the free end of the tape, letting the weighted end hang freely without swinging. Wait 3 seconds. At the intersection of the diameter tape 1008, read the diameter aligned with the zero mark of the diameter tape and record as the Original Roll Diameter to the nearest 0.01 inches. With the diameter tape still in place, and without any undue delay, carefully hang the 1000 g weight 1007 from the bottom of the 100 g weight, for a total weight of 1100 g. Wait 3 seconds. Again, read the roll diameter from the tape and record as the Compressed Roll Diameter to the nearest 0.01 inch. Calculate percent compressibility to the according to the following equation and record to the nearest 0.1%:

$$\%\ \text{Compressibility} = \frac{(\text{Original Roll Diameter}) - (\text{Compressed Roll Diameter})}{\text{Original Roll Diameter}} \times 100$$

Repeat the testing on 10 replicate rolls and record the separate results to the nearest 0.1%. Average the 10 results and report as the Percent Compressibility to the nearest 0.1%.

Core Kinetic Coefficient of Friction Measurement Test Method

Figure 1A:
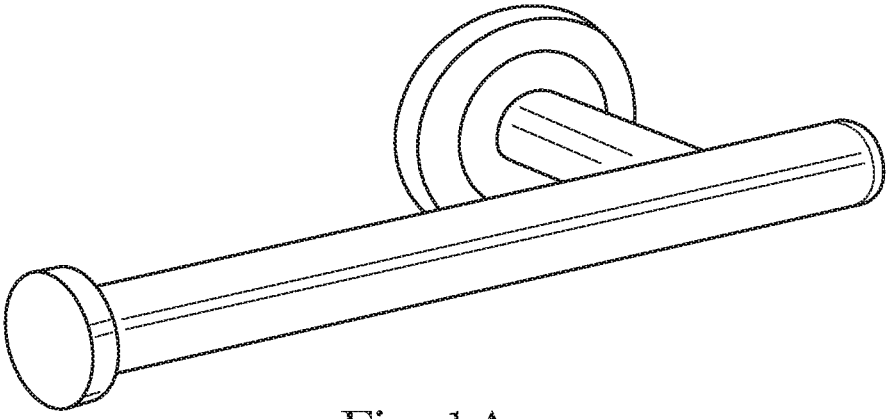
Fig. 1A PRIOR ART
FIG. 1A is an example of a prior art toilet tissue holder suitable for At Home toilet tissue rolls.
Figure 1B:
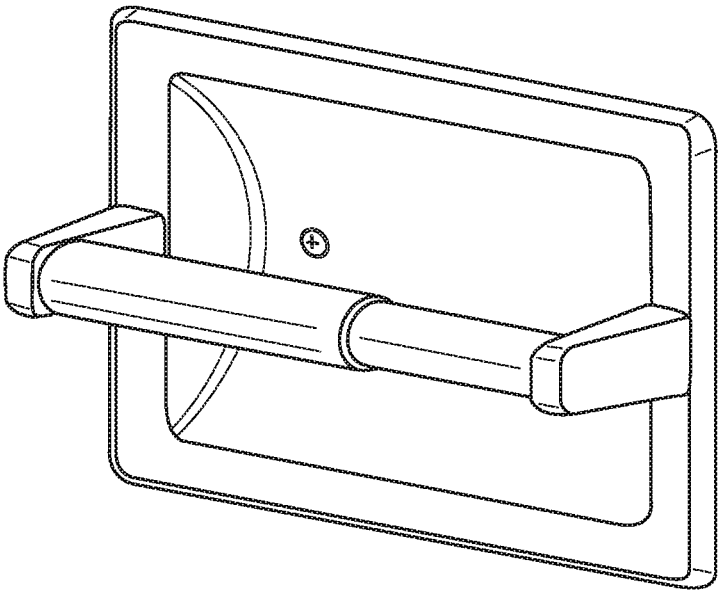
Fig. 1B PRIOR ART
FIG. 1B is another example of a prior art toilet tissue holder suitable for At Home toilet issue rolls.
Figure 1C:
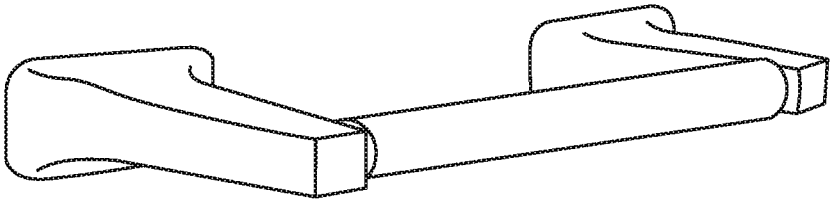
Fig. 1C PRIOR ART
FIG. 1C is another example of a prior art toilet tissue holder suitable for At Home toilet tissue rolls.
Figure 2A:
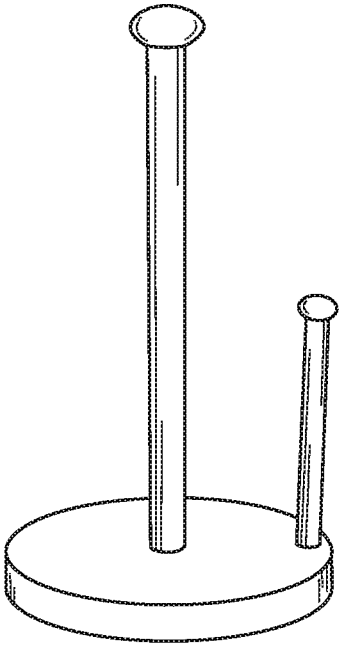
Fig. 2A PRIOR ART
FIG. 2A is an example of a prior art paper towel holder suitable for At Home paper towel rolls.
Figure 2B:
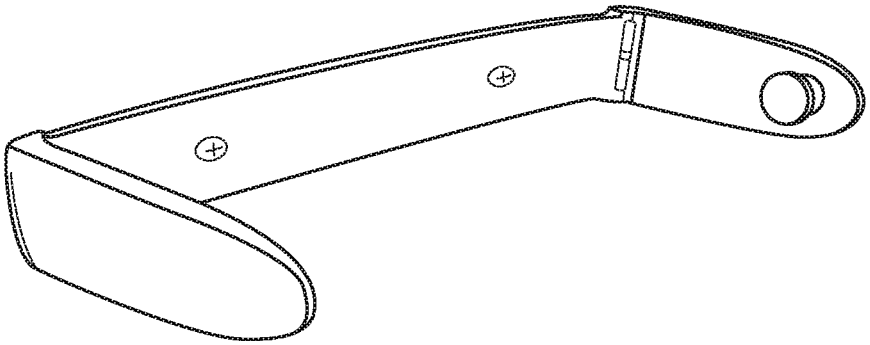
Fig. 2B PRIOR ART
FIG. 2B is another example of a prior art paper towel holder suitable for At Home paper towel rolls.
Figure 2C:
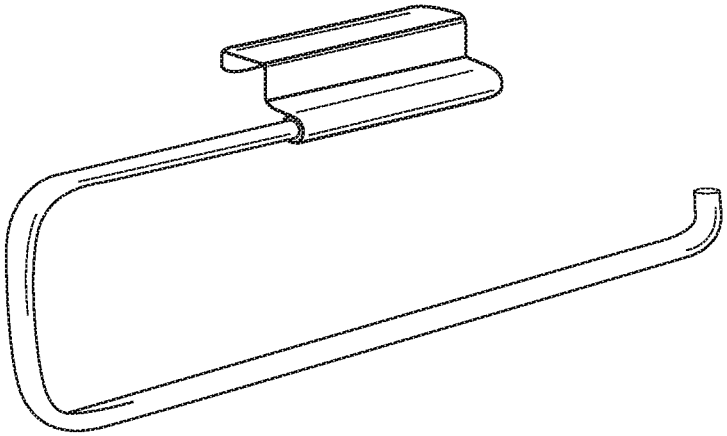
Fig. 2C PRIOR ART
FIG. 2C is another example of a prior art paper towel holder suitable for At Home paper towel rolls.
Figure 3A:
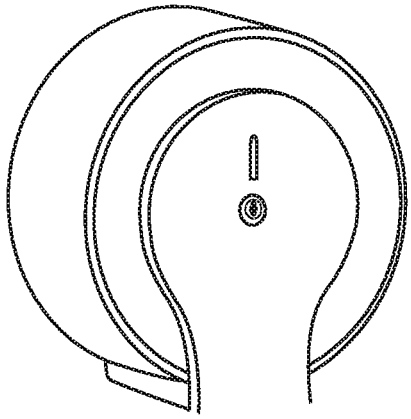
Fig. 3A PRIOR ART
FIG. 3A is an example of a prior art Away from Home toilet tissue dispenser.
Figure 3B:
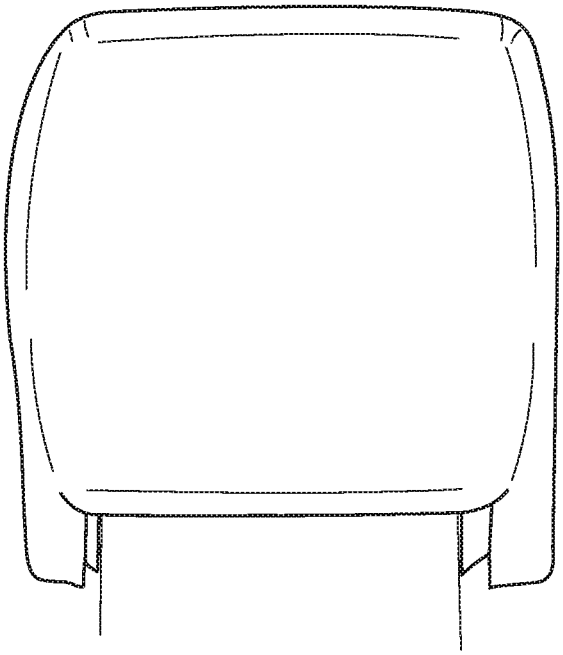
Fig. 3B PRIOR ART
FIG. 3B is an example of a prior art Away from Home paper towel dispenser.
Figure 3C:
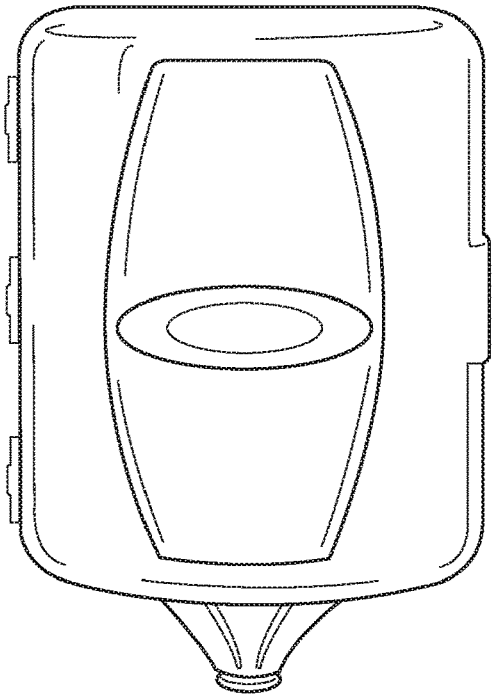
Fig. 3C PRIOR ART
FIG. 3C is an example of another prior art Away from Home paper towel dispenser.
Figure 4A:
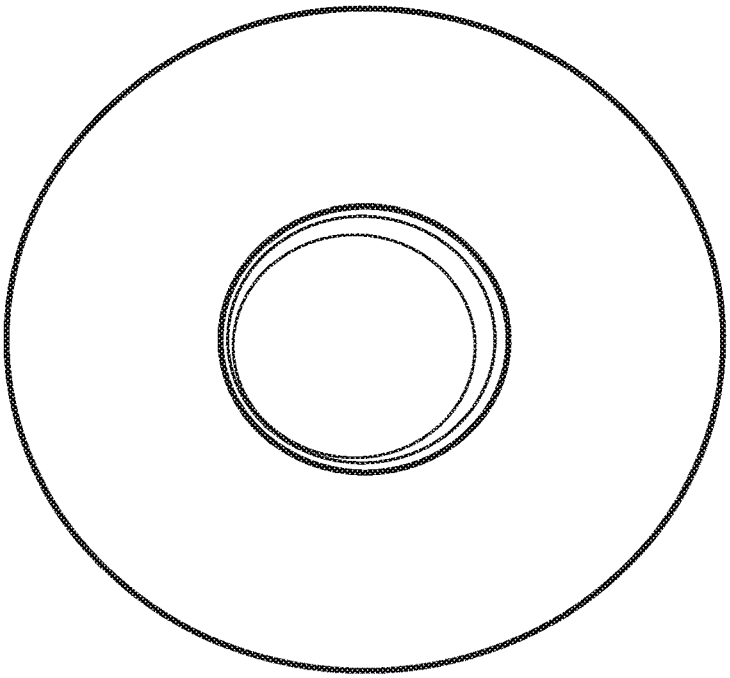
Fig. 4A PRIOR ART
FIG. 4A is a side view of an example of a prior art Away from Home toilet tissue roll.
Figure 4B:
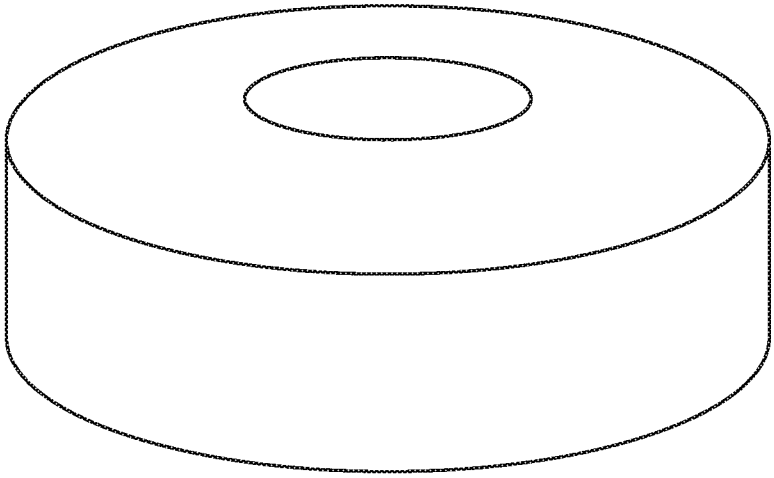
Fig. 4B PRIOR ART
FIG. 4B is a perspective view of the prior art Away from Home toilet tissue roll of FIG. 4A.
Figure 5A:
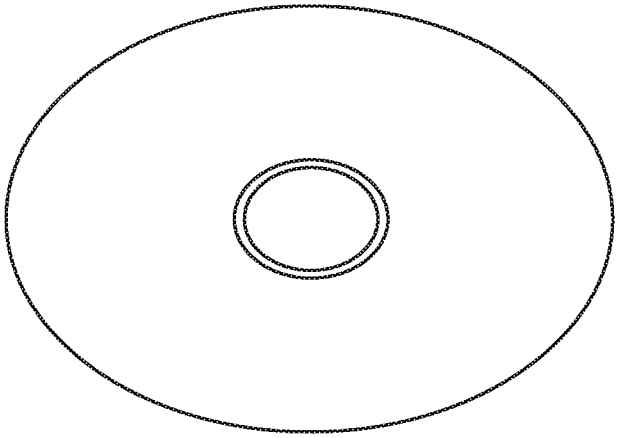
Fig. 5A PRIOR ART
FIG. 5A is a side view of an example of a prior art Away from Home paper towel roll.
Figure 5B:
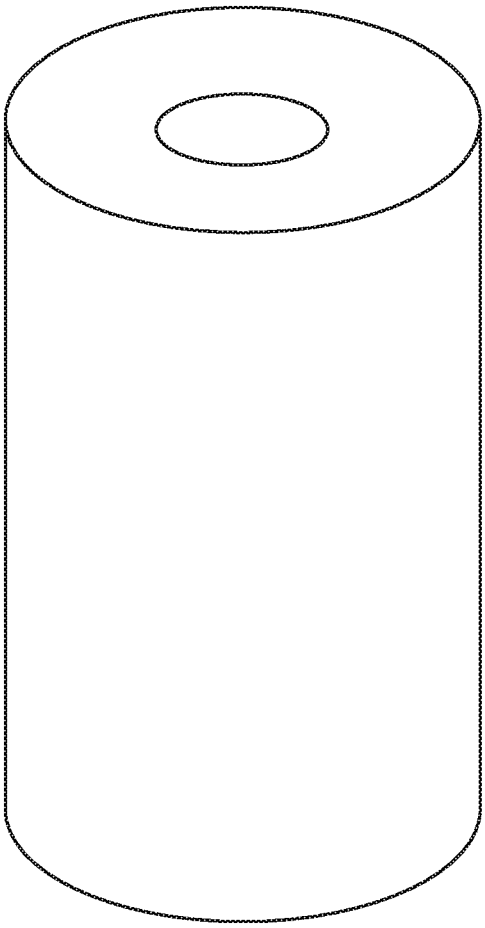
Fig. 5B PRIOR ART
FIG. 5B is a perspective view of the prior art Away from Home paper towel roll of FIG. 5A.

The Core Kinetic Coefficient of Friction (COF) of a roll core can be measured using ASTM Method D1894-14 with the following particulars. The test is performed on a constant rate of extension tensile tester with computer interface (a suitable instrument is the MTS Alliance using Testworks 4 Software, as available from MTS Systems Corp., Eden Prarie, Minn.) fitted with a coefficient of friction fixture and sled as described in D 1894-01 (a suitable fixture is the Coefficient of Friction Fixture and Sled available from Instron Corp., Canton, Mass.). The apparatus is configured as depicted in FIG. 1(*c*) of ASTM D1894-14 using a polished stainless steel sheet, finished with a grind surface of 320 grit, as the plane. A load cell is selected such that the measured forces are within 10-90% of the range of the cell. The tensile tester is programmed for a crosshead speed of 127 mm/min, and a total travel of 130 mm Data is collected at a rate of 100 Hz. All testing is performed in a conditioned room maintained at about 23±2° C. and about 50±2% relative humidity.

A hollow cylinder roll core is cut along its major axis, opened and laid flat. A square 6.35 cm by 6.35 cm test specimen is then cut out, with sides oriented parallel and perpendicular to the sides which formed the bases of the hollow cylinder. The specimen test surface must be free of debris, tears, and holes. Seams on the interior surface or external surface of the hollow cylinder roll core should be avoided if possible, if not possible then test specimens may comprise any extent of seams. Ten replicate specimens obtained from ten substantially similar cores are prepared for analysis. The specimens are conditioned at about 23° C.±2C.° and about 50%±2% relative humidity for 2 hours prior to testing.

A specimen is mounted onto the sled using double sided adhesive tape (tape should be wide enough to cover 100% of the sled's surface) with the core interior surface facing the stainless steel plane, oriented such that the specimen surface will be pulled in a direction replicating the motion of the core interior sliding over a core holder. The mass of the sled with mounted sample is recorded to 0.1 gram. The surface of the stainless steel plane is cleaned with isopropanol between each analysis.

The Core Kinetic COF is calculated as follows:

$$\text{Core Kinetic } COF = \frac{A_K}{B}$$

Where $A_K$ equals the average peak force in grams force (gf) recorded between 20 mm and 128 mm, and B equals the mass of sled in grams.

The remaining nine specimens are tested in the same manner The average Core Kinetic COF for the ten replicate specimens is calculated and reported to the nearest 0.01 units.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A multi-ply sanitary tissue product roll comprising a multi-ply sanitary tissue product comprising a non-embossed through-air-dried web, wherein the sanitary tissue product roll exhibits a Roll Diameter of greater than 8.25 inches as measured according to the Roll Diameter Test Method, a Moment of Inertia of greater than 1.50 g*m$^2$ as measured according to the Moment of Inertia Test Method, and a Roll Density of less than 0.250 g/cm$^3$ as measured according to the Roll Density Test Method, and a roll width of greater than 1.0 inches to less than 10.0 inches.

2. The multi-ply sanitary tissue product roll according to claim 1 wherein the multi-ply sanitary tissue product roll exhibits a roll width of less than 9.0 inches.

3. The multi-ply sanitary tissue product roll according to claim 1 wherein the multi-ply sanitary tissue product roll exhibits a roll width of less than 4.5 inches.

4. The multi-ply sanitary tissue product roll according to claim 1 wherein the multi-ply sanitary tissue product comprises one or more perforations.

5. The multi-ply sanitary tissue product roll according to claim 1 wherein the non-embossed through-air-dried web comprises an uncreped non-embossed through-air-dried fibrous structure.

6. The multi-ply sanitary tissue product roll according to claim 1 wherein the non-embossed through-air-dried web comprises a creped non-embossed through-air-dried fibrous structure.

7. The multi-ply sanitary tissue product roll according to claim 1 wherein the multi-ply sanitary tissue product roll further comprises an embossed through-air-dried fibrous structure.

8. The multi-ply sanitary tissue product roll according to claim 1 wherein the multi-ply sanitary tissue product roll further comprises two or more through-air-dried fibrous structures.

9. The multi-ply sanitary tissue product roll according to claim 1 wherein the sanitary tissue product is convolutely wound about a core.

10. The multi-ply sanitary tissue product roll according to claim 9 wherein the core exhibits an outer diameter of less than 2.25 inches.

11. The multi-ply sanitary tissue product roll according to claim 10 wherein the multi-ply sanitary tissue product roll exhibits a Core Kinetic Coefficient of Friction value of greater than 0.10 and less than 0.50 as measured according to the Core Kinetic Coefficient of Friction Measurement Test Method.

12. The multi-ply sanitary tissue product roll according to claim 1 wherein the multi-ply sanitary tissue product is void of permanent wet strength.

13. The multi-ply sanitary tissue product roll according to claim 1 wherein the multi-ply sanitary tissue product exhibits permanent wet strength.

14. The multi-ply sanitary tissue product roll according to claim 1 wherein the multi-ply sanitary tissue product roll is a toilet tissue roll.

15. The multi-ply sanitary tissue product roll according to claim 1 wherein the multi-ply sanitary tissue product roll is a paper towel roll.

16. A package comprising one or more multi-ply sanitary tissue product rolls according to claim 1.

17. The package according to claim 16 wherein the package comprises a single multi-ply sanitary tissue product roll.

18. The package according to claim 16 comprises a material selected from the group consisting of: a film overwrap, a film bag, a cartonboard, a corrugated board, a cardboard, and combinations thereof.

* * * * *